US005915673A

United States Patent [19]

Kazerooni

[11] Patent Number: 5,915,673

[45] Date of Patent: Jun. 29, 1999

[54] PNEUMATIC HUMAN POWER AMPLIFER MODULE

[76] Inventor: Homayoon Kazerooni, 2806 Ashby Ave., Berkeley, Calif. 94705

[21] Appl. No.: 08/877,094

[22] Filed: Jun. 17, 1997

Related U.S. Application Data

[63] Continuation-in-part of application No. 08/624,038, Mar. 27, 1996.

[51] Int. Cl.[6] ..... B66D 1/00

[52] U.S. Cl. ..... 254/270; 254/264; 254/274; 254/331; 254/360; 414/5; 212/285

[58] Field of Search ..... 254/266, 270, 254/274, 331, 360, 361, 362; 212/331, 330, 338, 285; 414/2, 4, 5

[56] References Cited

U.S. PATENT DOCUMENTS

| | | | |
|---|---|---|---|
| 2,940,608 | 6/1960 | Underwood et al. | 212/124 |
| 3,384,350 | 5/1968 | Powell | 254/172 |
| 3,773,296 | 11/1973 | McKendrick | 254/189 |
| 3,791,627 | 2/1974 | Stone et al. | 254/168 |
| 3,907,120 | 9/1975 | Johnston et al. | 212/26 |
| 3,921,959 | 11/1975 | Ulbing | 254/168 |
| 3,933,388 | 1/1976 | Conboy | 294/64 |
| 3,940,110 | 2/1976 | Motoda | 254/168 |
| 4,302,138 | 11/1981 | Zarudinasky | 414/5 |
| 4,500,074 | 2/1985 | Fox et al. | 254/270 |
| 4,557,659 | 12/1985 | Scaglia | 414/627 |
| 4,636,962 | 1/1987 | Broyden et al. | 364/478 |
| 4,730,743 | 3/1988 | Rosman | 212/205 |
| 4,775,289 | 10/1988 | Kazerooni | 414/735 |
| 4,789,135 | 12/1988 | Watanabe | 254/362 |
| 4,844,421 | 7/1989 | Kojima | 254/270 |
| 4,884,941 | 12/1989 | Kazerooni | 414/744.5 |
| 4,917,360 | 4/1990 | Kojima | 254/362 |
| 5,139,156 | 8/1992 | Nakamura | 212/149 |
| 5,147,263 | 9/1992 | Mueller | 482/112 |
| 5,184,319 | 2/1993 | Kramer | 364/806 |
| 5,270,621 | 12/1993 | Kiiski | 318/55 |
| 5,350,075 | 9/1994 | Kahlman | 212/159 |
| 5,437,432 | 8/1995 | Fujikawa | 254/362 |
| 5,451,134 | 9/1995 | Bryfogle | 414/680 |
| 5,480,125 | 1/1996 | Bitsch et al. | 254/264 |
| 5,489,032 | 2/1996 | Mayhall, Jr. et al. | 212/285 |
| 5,520,368 | 5/1996 | Braesch et al. | 254/274 |
| 5,549,712 | 8/1996 | Gammer et al. | 623364/60 |
| 5,551,308 | 9/1996 | Aria et al. | 73/862.541 |
| 5,556,077 | 9/1996 | Braesch et al. | 254/267 |
| 5,576,727 | 11/1996 | Rosenberg et al. | 345/179 |
| 5,584,646 | 12/1996 | Lewis et al. | 414/738 |
| 5,632,469 | 5/1997 | Heun et al. | 254/267 |
| 5,671,912 | 9/1997 | Langford et al. | 254/267 |
| 5,707,094 | 1/1998 | Gower | 294/65 |

*Primary Examiner*—Katherine Matecki
*Attorney, Agent, or Firm*—Skjerven, Morrill, MacPherson, Franklin & Friel LLP; David E. Steuber

[57] ABSTRACT

A pneumatic human power amplifier module is usable in conjunction with a wide variety of pneumatic actuators and lifting devices to provide a human power amplifier for lifting a load. The module includes an end-effector, an electronic controller and a pneumatic circuit. The end-effector contains a human interface subsection which is grasped by a human operator and a load interface subsection which engages the load to be lifted. A force sensor in the end-effector detects the force imposed by the operator on the end-effector and transmits a signal representing the magnitude of the force to the controller. The controller in turn sends a command to the pneumatic circuit, which controls the flow of air into the associated pneumatic actuator. The actuator drives the lifting device. The controller and the pneumatic circuit are arranged such that the lifting device and the operator share the burden of lifting the load, with the operator supplying a predetermined percentage of the total force required to lift the load regardless of the size of the load.

39 Claims, 19 Drawing Sheets

PNEUMATIC HUMAN POWER AMPLIFER MODULE

This application is a continuation-in-part of copending application Ser. No. 08/624,038, filed Mar. 27, 1996 (pending), which is incorporated herein by reference in its entirety.

FIELD OF THE INVENTION

The present invention relates to material handling devices and, more specifically, to a material handling device that amplifies the force a human exerts when the human lifts or lowers an object in the vertical direction.

BACKGROUND OF THE INVENTION

Several types of material handing devices are known. One type of material handling device, known as a balancer, consists of a motorized take-up pulley, a rope which wraps around the pulley when the pulley turns, and an end-effector which is attached to the end of the rope. The end-effector has components that connect to the load being lifted. The rotation of the pulley winds or unwinds the rope and causes the end-effector to lift or lower the load. In this class of material handling system, an upward force in the rope exactly equal to the gravity force of the object being lifted is generated by an actuator; the rope tension is equal to the weight of the object. Therefore, the only force the operator must impose to maneuver the object is the force necessary to overcome the object's inertia. This force can be substantial if the mass of the object is large. Therefore, the ability to accelerate or decelerate a heavy object is limited by the operator's strength.

There are two ways of creating a force in the rope so that it is exactly equal to the object weight. First, if the system is pneumatically powered, the air pressure is adjusted so that the lift force equals the weight of the load. Second, if the system is electrically powered, the correct voltage or current (depending on the control circuitry) is provided to an amplifier to generate a lift force that equals the load weight. These types of systems are not suited to maneuvers in which objects of varied weights are lifted. This is true because each object requires a different bias force to cancel its weight force. This annoying adjustment can be done either manually by the operator or electronically by measuring the object weight.

For example, the BA Series of balancers made by Zimmerman International Corporation work based on the above principle. The air pressure is set and controlled by a valve to maintain a constant load balance. The operator has to manually reach the actuator and set the system to a particular pressure to generate a constant tensile force on the rope.

The LIFTRONIC System machines made by Scaglia of Italy also belong to the family of balancers, but they are electrically powered. As soon as the system grips the load, the LIFTRONIC machine creates an upward force in the rope which is equal and opposite to the weight of the object being held. These machines may be considered superior to the Zimmerman BA Series balancers because they have an electronic circuit that balances the load during the initial few moments when the load is grabbed by the system. As a result, the operator does not have to reach the actuator on top and adjust the initial force in the rope. In this system, the load weight is measured first by a force sensor in the system. While this measurement is being performed, the operator should not touch the load, but instead should allow the system to find the object's weight. If the operator does touch the object, the force reading will not be correct. The LIFTRONIC machine then creates an upward force in the rope which is equal and opposite to the weight of the object being held.

Balancers of the kind described above do not give the operator a sense of the force required to lift the load. Also, only the weight of the object is canceled by the rope's tension. Moreover, such balancers are generally not versatile enough to be used in situations in which load weights vary.

Another class of machines is similar in architecture to the machines described above, but the operator uses an intermediary device such as a valve, pushbutton, keyboard, switch, or teach pendent to adjust the lifting and lowering speed of the object being maneuvered. For example, the more the operator opens the valve, the greater the speed generated to lift the object. With an intermediary device, the operator is not in physical contact with the load being lifted, but is busy operating a valve or switch. The operator does not have any sense of how much he/she is lifting because his hand is not in contact with the object. Although suitable for lifting objects of various weights, this type of system is not comfortable for the operator because the operator must focus on an intermediary device (i.e valve, pushbutton, keyboard, or switch). Thus, the operator pays more attention to operating the intermediary device than to the speed of the object. This makes the lifting operation rather unnatural.

SUMMARY OF THE INVENTION

All of the foregoing deficiencies are overcome in a human power amplifier according to this invention.

The human power amplifier includes an end-effector to be held by a human operator; an actuator such as an electric or air-powered or hydraulic motor; a computer or other type of controller for controlling the actuator; and a rope, cable, wire, bar or other force transmission member for transmitting a lifting force from the actuator to the end-effector. The end-effector provides an interface between the human operator and an object which is to be lifted. A force transfer mechanism such as a pulley, drum or winch is used to apply the force generated by the actuator to the rope or other member which transmits the lifting force to the end-effector. (Note that the word "lifting" herein refers to both lifting and lowering motions.)

The end-effector includes a human interface subsystem and a load interface subsystem. The load interface subsystem in configured so as to grip or otherwise attach to the load and may include, for example, a suction cup, a magnet, or a mechanical member shaped to conform to a surface of the load. The human interface subsystem includes a force sensor which is mounted so as to measure the vertical force imposed on the end-effector by the human operator. A wide variety of force sensors may be used, including strain gauges, load cells, and piezoelectric devices. The vertical force on the end-effector may also be detected by measuring the displacement of a resilient element such as a spring.

A signal representing the vertical force imposed on the end-effector by the human operator, as measured by the force sensor, is transmitted to the controller which is associated with the actuator. The controller causes the actuator to lift the end-effector appropriately so always only a preprogrammed small proportion of the load force is lifted by the human operator, with the remaining force being provided by the actuator. Therefore, the actuator adds effort to the lifting task only in response to the operator's hand force. With this load sharing concept the operator has the sense that he or she is lifting the load, but with far less force than would ordinarily be required. The force applied by the actuator takes into account both the gravitational and inertial forces that are necessary to move the load. Since the force applied by the actuator is automatically determined by the force applied to the end-effector by the operator, there is no need to set or adjust the human power amplifier for loads having different weights.

There is no switch, valve, keyboard, teach pendent, or pushbutton in the human power amplifier to control the lifting speed of the load. Rather, the contact force between the human hand and the end-effector is used to control the lifting speed of the load. The human hand force is measured, and these measurements are used by the controller to calculate the required speed of the force transmission member so as to create sufficient mechanical strength to assist the operator in the lifting task. In this way, the device follows the human arm motions in a "natural" way. When the human uses this device to manipulate a load, a well-defined small portion of the total force (gravity plus acceleration) is lifted by the human. This force gives the operator a sense of how much weight he/she is lifting. Conversely, when the operator does not apply any vertical force (upward or downward) to the end-effector, the actuator does not move the force transmission member at all, and the load remains motionless.

In one embodiment, the actuator comprises an electric motor with a transmission and the force transmission member comprises a rope from which the end-effector is suspended. A single end-effector can be used, with the operator gripping the end-effector with one hand, or a pair of end-effectors connected to the actuator, preferably by means of a pulley arrangement, can be used, with the operator gripping one of the end-effectors in each hand.

Another group of embodiments comprise a pneumatic human power amplifier module which can be used in conjunction with a variety of pneumatic material handling devices, typically including a pneumatic actuator and a lifting device. The pneumatic human power amplifier module is highly versatile and in effect converts a conventional pneumatic material handling device into a human power amplifier.

The pneumatic human power amplifier module includes an end-effector, an electronic controller, and a pneumatic circuit including a proportional servovalve and optionally a directional servovalve. The end-effector is connected to the pneumatic material handling device, and provides an interface between the device and a human operator.

A signal representing the vertical force imposed on the end-effector by the human operator is measured by a force sensor within the end-effector and is transmitted to the electronic controller. The controller in turn sends a command to the pneumatic circuit, thereby operating the proportional servovalve and causing the pneumatic actuator to move the material handling device appropriately so the human operator lifts a pre-programmed (typically smaller) portion of the load force. The actuator lifts the remaining (typically larger) portion of the load force. The measured force of the human against the end-effector is used by the controller to calculate the correct speed of the actuator. The actuator in turn creates sufficient mechanical force in the material handling device to assist the operator in the lifting task.

In one group of embodiments the pneumatic circuit also includes a directional servovalve associated with a pair of UP and DOWN switches which allow the proportional servovalve to be bypassed in situations, for example, when the operator is not attending the end-effector or a component of the controller is malfunctioning.

Thus a material handling device equipped with a pneumatic human power amplifier module of this invention amplifies the force that the human exerts when the human uses the end-effector to lift or lower an object: that is, the material handling device lifts a pre-programmed larger percentage of the total force of the load (i.e., gravity plus acceleration), while the human lifts the remaining smaller percentage of the total load force. The contact force between the human and the end-effector is used to control the actuator and consequently the motion of the during load manipulation. This contact force is felt as a feedback by the human operator, providing a sense of how much weight he/she is lifting.

Existing manual material handling devices have pneumatic actuators which usually power a single degree of freedom. The system is arranged such that this degree of freedom contributes primarily to lifting and lowering the load.

Using the power amplifier module there is no need to set or adjust the actuator for loads of different weights, because the force applied by the actuator to the load is determined automatically by the electronic controller, based on the force applied by the operator to the end-effector and on the dynamic behavior of the manual material handling device.

DETAILED DESCRIPTION OF THE INVENTION

Figure 1:
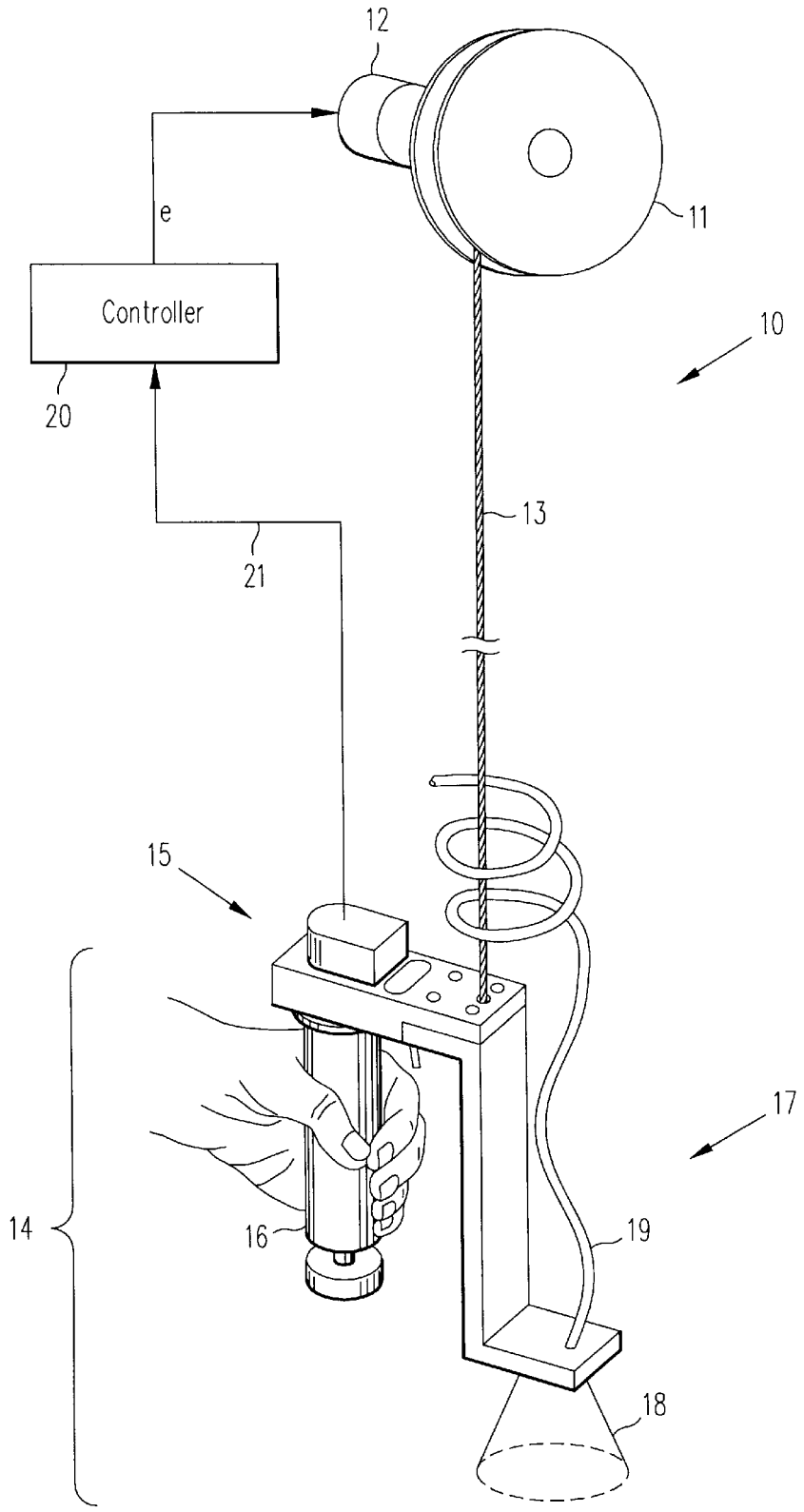
FIG. 1 illustrates an embodiment of the human power amplifier which includes a single end-effector.

FIG. 1 illustrates a first embodiment of the invention, showing a human power amplifier 10. At the top of the device, a take-up pulley 11, driven by an actuator 12, is attached directly to a ceiling, wall, or overhead crane (not shown). Encircling pulley 11 is a rope 13. Rope 13 is capable of lifting or lowering a heavy load when the pulley 11 turns. Attached to rope 13 is an end-effector 14, which includes a human interface subsystem 15 (including a handle 16) and a load interface subsystem 17, which in this embodiment includes a suction cup 18. Also shown is an air hose 19 for supplying suction cup 18 with low-pressure air. Actuator 12 is driven by an electronic controller 20, which receives signals from end-effector 14 over a signal cable 21.

In one embodiment actuator 12 is an electric motor with a transmission, but alternatively it can be an electrically-powered motor without a transmission, an air powered rotary actuator with or without transmission, an air-powered linear actuator with a mechanical transmission to convert the linear motion to rotary motion, a hydraulic rotary actuator, or a hydraulic linear actuator with a mechanical transmission to convert the linear motion to rotary motion. As used herein, transmissions are mechanical devices such as gears, pulleys and ropes which increase or decrease the tensile force in the rope. Pulley 11 can be replaced by a drum or a winch or any mechanism that is able to convert the motion provided by actuator 12 to a vertical motion which lifts and lowers rope 13. Although in this embodiment actuator 12 directly powers the take-up pulley 11, one can mount actuator 12 at another location and transfer power to take-up pulley 11 via another transmission system such as an assembly of chains and spockets. Controller 20 can be an analog circuit, a digital circuit, or a computer with input output capability.

Human interface subsystem 15 is designed to be gripped by a human hand and measures the human force, i.e., the force applied by the human operator against human interface subsystem 15. Load interface subsystem 17 is designed to interface with the load contains various holding devices. The load force is defined as the force imposed by the load on load interface subsystem 17. The design of the load interface subsystem depends on the geometry of the object being lifted and other factors related to the lifting operation. In addition to the suction cup 18 shown in FIG. 1, hooks and grippers are examples of other means that connect to load interface subsystems. For lifting heavy objects, the load interface subsystem may contain several suction cups.

The human interface subsystem 15 of end-effector 14 contains a sensor (described below) which measures the magnitude of the vertical force exerted by the human operator. If the operator's hand pushes upward on the handle 16, the take-up pulley 11 moves the end-effector 14 upward. If the operator's hand pushes downward on the handle 16, the take-up pulley moves the end-effector 14 downward. The measurements of the forces from the operator's hand are transmitted to the controller 20 over signal cable 21. Using these measurements, the controller 20 calculates the amount of pulley rotation necessary to either raise or lower the rope 13 the correct distance to create enough mechanical strength to assist the operator in the lifting task as required. Controller 20 then commands actuator 12 to cause pulley 11 to rotate. All of this happens so quickly that the operator's lifting efforts and the device's lifting efforts are for all purposes synchronized perfectly. The operator's physical movements are thus translated into a physical assist from the machine, and the machine's strength is directly and simultaneously controlled by the human operator. In summary, the load moves vertically because of the vertical movements of both the operator and the pulley.

In this mode of operation, for more stability, one might use an end-effector with two handles. In this case, only one handle needs to be instrumented. For lifting heavy objects, one can use two human power amplifiers similar to the human power amplifier 10 shown in FIG. 1, one for the left and one for the right hand.

Figure 2:
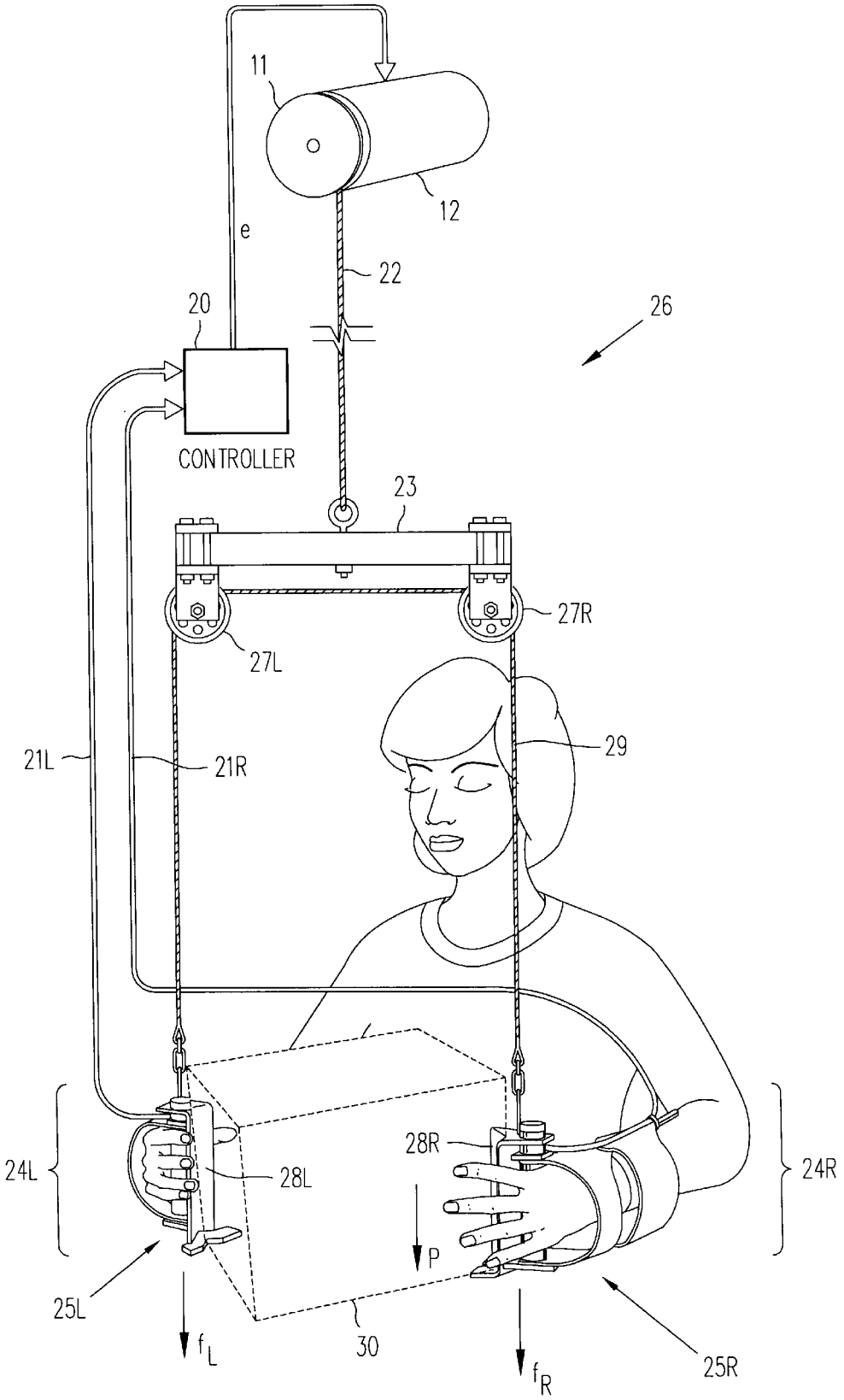
FIG. 2 illustrates an embodiment of the human power amplifier which includes a pair of end-effectors.

A second embodiment of the invention is shown in FIG. 2. In this embodiment, the operator must use both his/her hands to lift the object. In this embodiment, the operator can orient the object being lifted without introducing any other motion to the object.

In the human power amplifier 20 shown in FIG. 2, hanging from pulley 11 is a rope 22. This rope is connected to the horizontal midpoint of a bar 23. Hanging from each end of bar 23 is a single pulley: a left pulley 27L at one end and a right pulley 27R at the other end. Pulleys 27L and 27R are not motorized, but are free to rotate in response to forces on the single continuous rope 29 that runs over pulleys 27L and 27R. Because pulleys 27L and 27R can rotate freely, rope 29 moves freely whenever a force is applied at either end of rope 29; if the end beneath pulley 27L is pulled downward, the end beneath pulley 27R moves upward, and vice versa. End-effectors 24L and 24R, connected to the ends of rope 29, are similar to end-effector 14 shown in FIG. 1, except that suction cup 18 has been omitted and angle pieces 28L and 28R are suited to lifting a box 30.

End-effectors 24L and 24R include human interface subsystems 25L and 25R, respectively. The magnitudes of the vertical forces from the operator's hand movements are measured by sensors (described below) within human interface subsystems 25L and 25R and transmit signals to controller 20 over signal cables 21L and 21R. The sensors within end-effectors 24L and 24R electronically detect the vertical forces from the operator's hands, such as an upward movement of the hands to lift box 30. If both of the operator's hands push upward on the handles, the pulley 11 moves the load-supporting system upward. If both of the operator's hands push downward on the handles, the take-up pulley moves the load-supporting system downward. If the operator pushes upward on one end-effector and downward on the other end-effector, the net force measured by the force sensors is zero, so the pulley 11 does not rotate, and thus the entire device does not move. However the operator can now rotate the object. In this embodiment, only one end-effector (either left or right) can be instrumented. For a given controller, the force amplification (described below) when only one end-effector is instrumented, is smaller than the force amplification when both end-effectors are instrumented.

Several embodiments of the end-effector will now be described.

Figure 3:
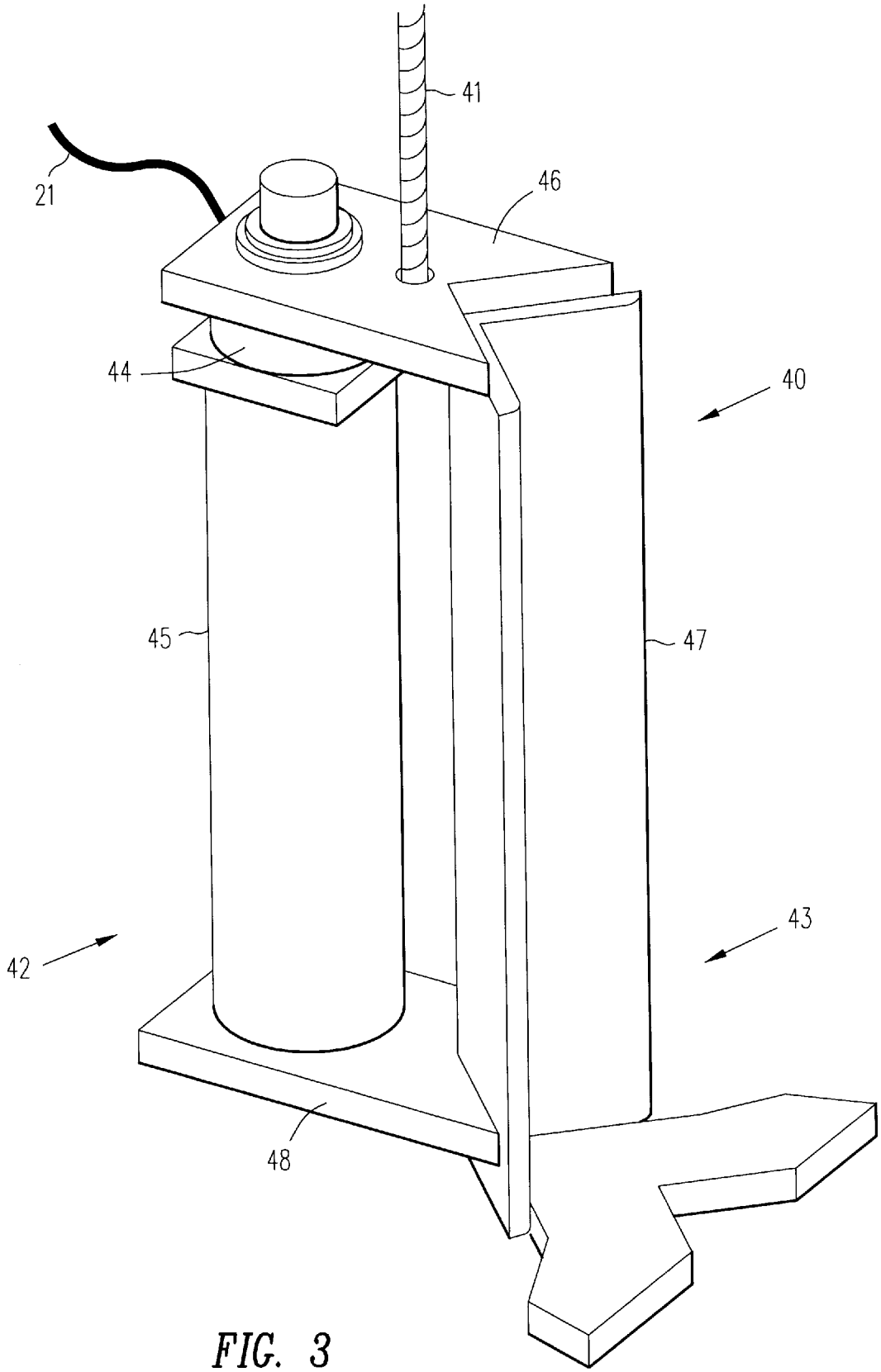
FIG. 3 illustrates a detailed view of a first embodiment of an end-effector.

The first embodiment is shown in FIG. 3. End-effector 40 is connected to a rope 41 and includes a human interface subsystem 42 and a load interface subsystem 43. Rope 41 could be, for example, either rope 13 (FIG. 1) or rope 29 (FIG. 2)

A force sensor 44 is installed between a handle 45 and a bracket 46 to measure the human force in the vertical direction on handle 45. Handle 45 is held by the operator. If handle 45 is pushed up or down, force sensor 44 measures the human force. Handle 45 is shown as a cylinder in FIG. 3, but it can be of any shape that is comfortable for the operator. For example, a horizontally oriented circular bar (similar to a steering wheel) can be connected to handle 45 at its center to enable the operator to grasp handle 45 from any direction.

A bracket 46 is connected to the rope 41. Although the right-hand side of bracket 46 can connect to various load interface devices such as suction cups or hooks, in the embodiment shown in FIG. 3 bracket 46 is welded to an angular bracket 47, which is used to hold an edge or a corner of a box. This makes the end-effector suitable for maneuvering in a system of the kind shown in FIG. 2, wherein a pair of end-effectors contact a load at two locations and are capable of rotating the load about its own axis. Angular bracket 47 touches a plate 48 which is connected to handle 45, but these two elements can freely slide vertically relative to each other because they are not connected. This free sliding motion between plate 48 and bracket 47 guarantees that the forces from the operator which are in the vertical direction pass through force sensor 44 without any resistance, while the forces from the operator which are not in the vertical direction are transferred to bracket 47 through plate 48. If these non-vertical forces were to pass through the force sensor, they could either produce a false reading in the sensor or damage the force sensor assembly.

In operation, the operator grips handle 45. If the operator pushes downward on handle 45, force sensor 44 generates a positive signal proportional to the downward force. If the operator pushes upward on handle 45, force sensor 44 generates a negative signal proportional to the human upward force.

A significant characteristic of end-effector 40 is that force sensor 44 measures only the human force imposed against the human interface subsystem 42, not the load force (the force imposed on the load interface subsystem by the load).

Figure 4:
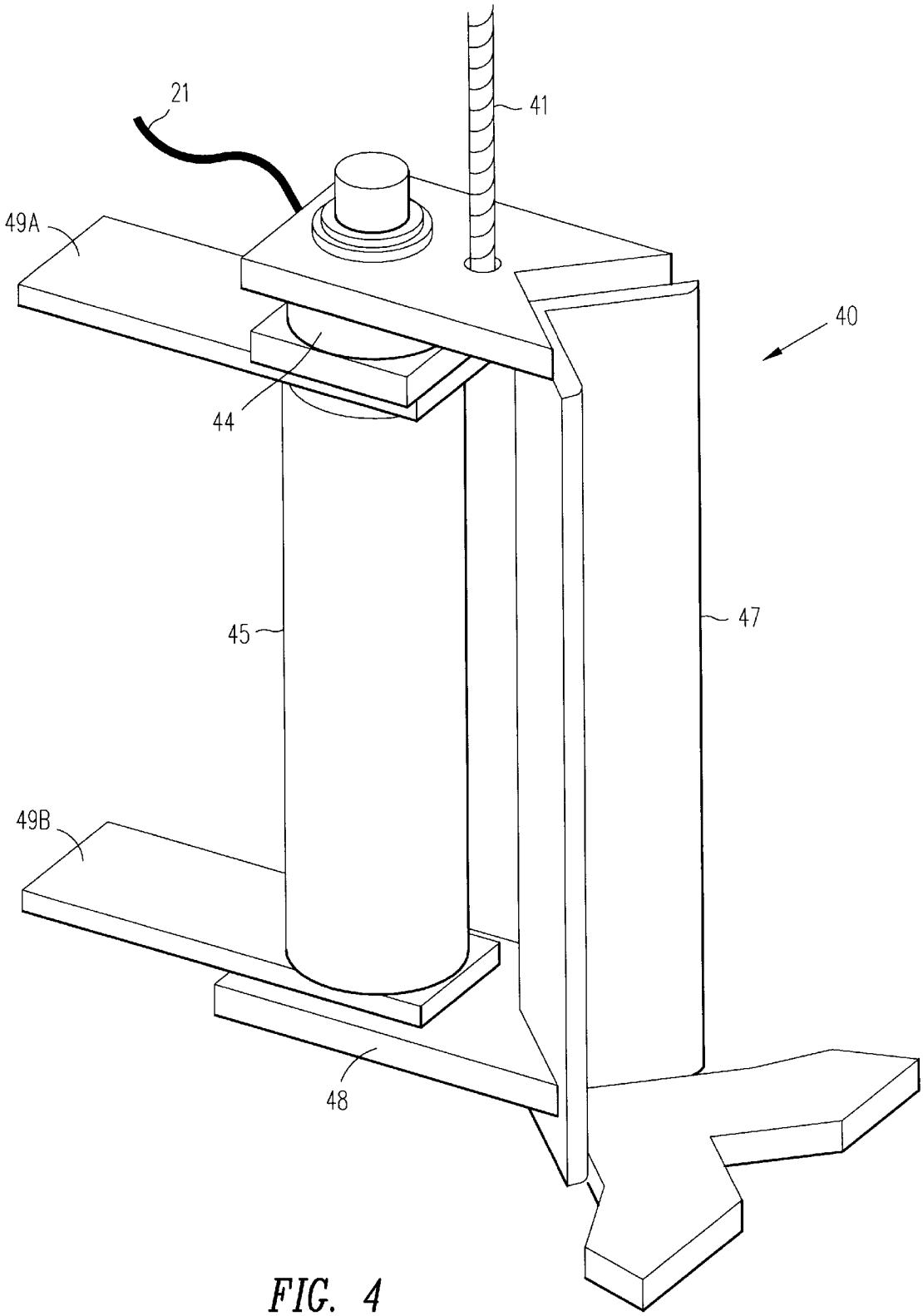
FIG. 4 illustrates a modified version of the end-effector shown in FIG. 3 including support plates for connecting the end-effector to a brace for the operator's hand and/or arm.
Figure 5:
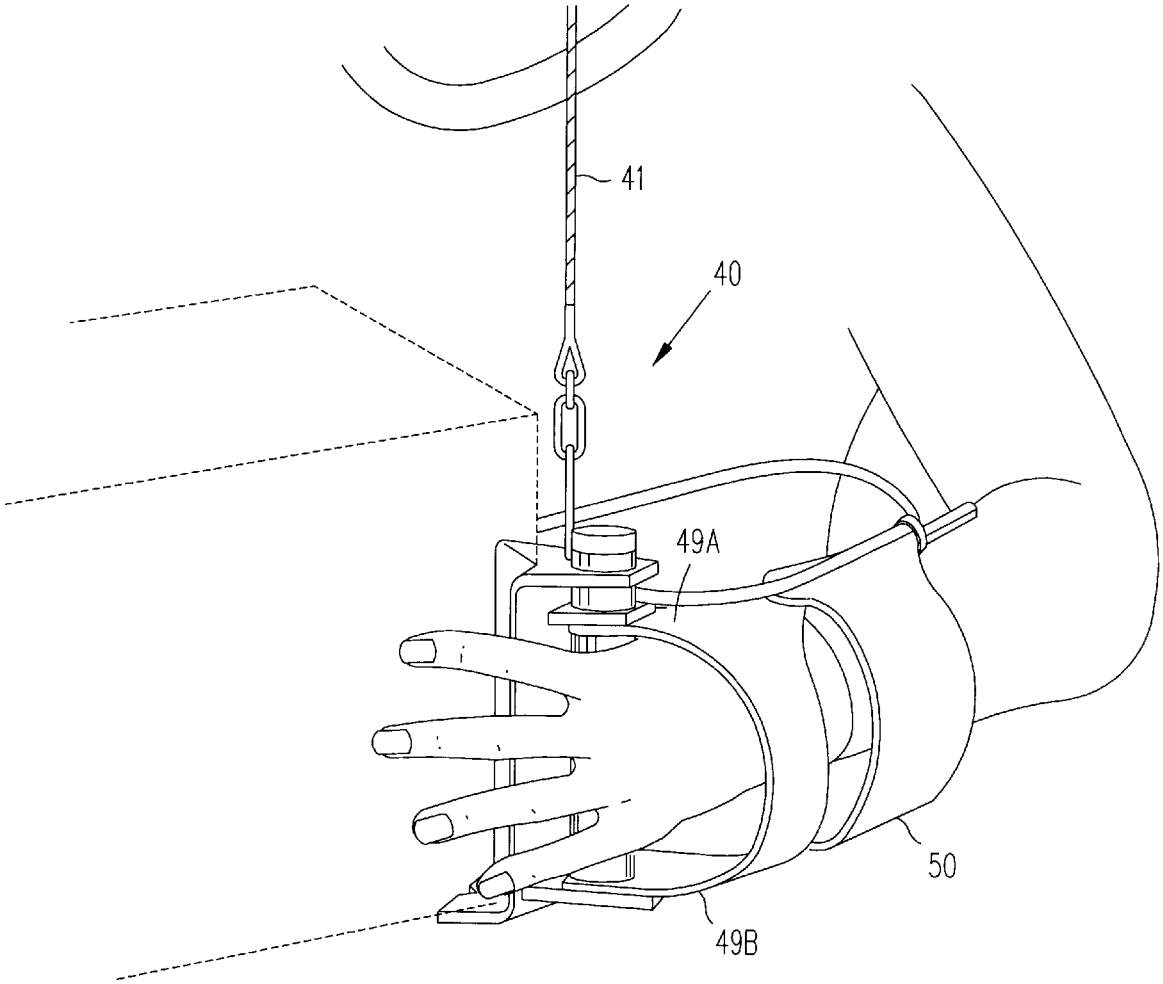
FIG. 5 illustrates an embodiment of a brace.

FIG. 4 shows a modified version of end-effector 40 with two support plates 49A and 49B that can connect to a brace for the operator's hand and arm. This is particularly useful when the human operator does not grasp the handle with his or her fingers. Suppose, for example, that handle 45 has a small radius and that the distance between handle 45 and angular bracket 47 is so small that the operator's fingers cannot wrap around the handle 45. Adding plates 49A and 49B allows the operator to exert force on handle 45 without holding it with his or her fingers. Moreover, a brace 50, as shown in FIG. 5, has been proven to create more stability and comfort for some operators.

When the operator initiates an upward motion, the human force which he or she exerts is recorded by the force sensor. The signal then generated by the force sensor is transmitted to the controller. The actuator and the take-up pulley turn appropriately, causing an upward motion of the rope and the end-effector assembly. This lifts the load and the end-effector together. Similarly, when the operator initiates a downward motion, the actuator and the take-up pulley turn appropriately, causing a downward motion of the rope and the end-effector assembly.

Force sensor 44 can be selected from a variety of force sensors that are available in the market, including piezo-electric based force sensors, metallic strain gage force sensors, semiconductor strain gage force sensors, and force sensing resistors. Regardless of the particular type of force sensor chosen and its installation procedure, the design should be such that the force sensor measures only the human force against end-effector 40.

Figure 6:
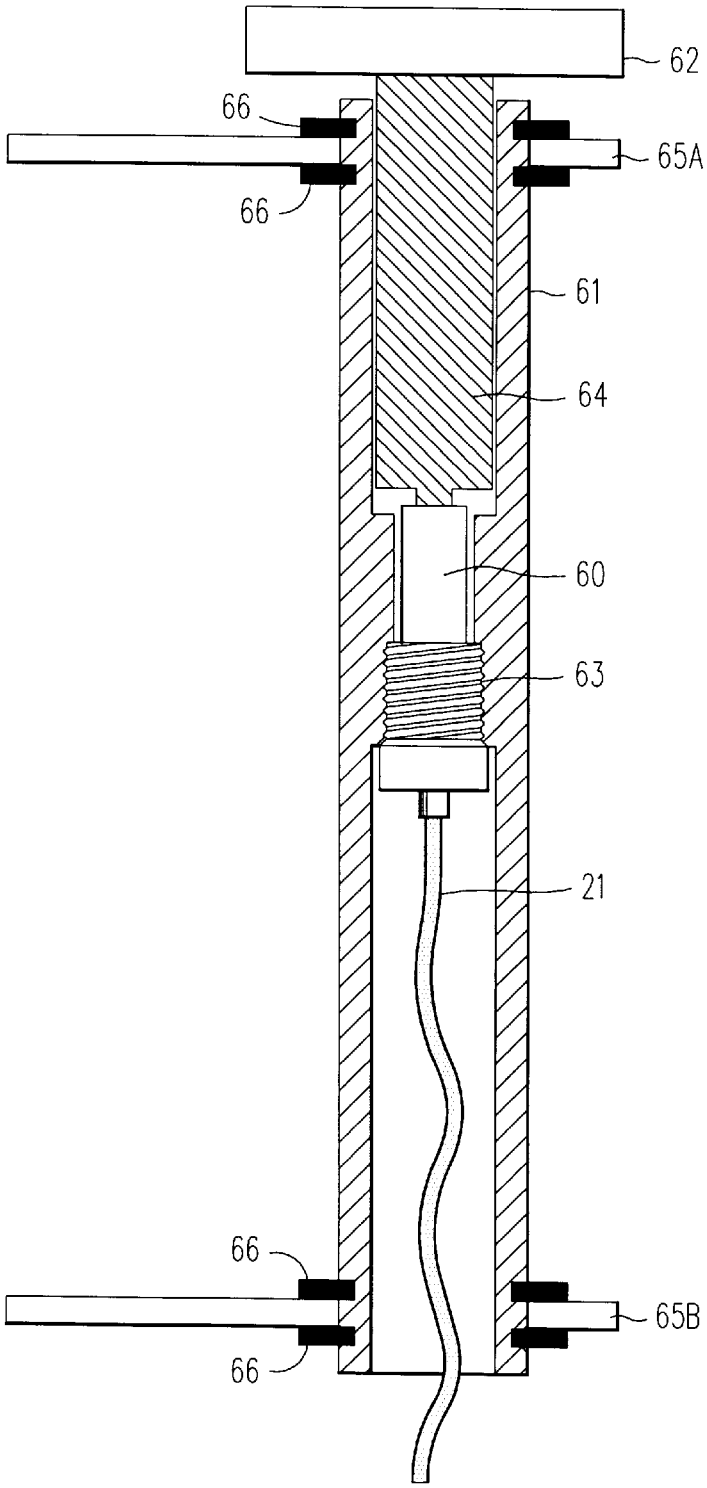
FIG. 6 illustrates a cross-sectional view of an embodiment of an end-effector, showing in particular the structure of the force sensor.

FIG. 6 shows a version of end-effector 40 which measures the vertical human force via a different type of force sensor installation. A force sensor 60, which may be similar to force sensor 44, is installed between a handle 61 and a bracket 62 and is connected to controller 20 via signal cable 21. Force sensor 60 has a threaded part 63 that screws into an inside bore within handle 61, which is grasped by the human operator. The other side of the force sensor 60 is connected to bracket 62 via a cylinder 64. The outside diameter of cylinder 64 is slightly smaller than the inside diameter of handle 61. This clearance allows a sliding motion between handle 61 and cylinder 64, which guarantees that the forces from the operator which are in the vertical direction pass through force sensor 60 without any resistance and that the forces from the operator which are not in the vertical direction are transferred to bracket 62 and not to force sensor 60. If these non-vertical forces pass through force sensor 60, they may either introduce false readings in the sensor or damage the force sensor assembly.

FIG. 6 also shows support plates 65A and 65B which can be connected to a brace for the operator's hand and/or arm. Four retaining rings 66 fit into slots in handle 61 to secure plates 65A and 65B and the brace to handle 61. Bracket 62 bolts to various load interface devices such as a hook or a suction cup (not shown).

Figure 7:
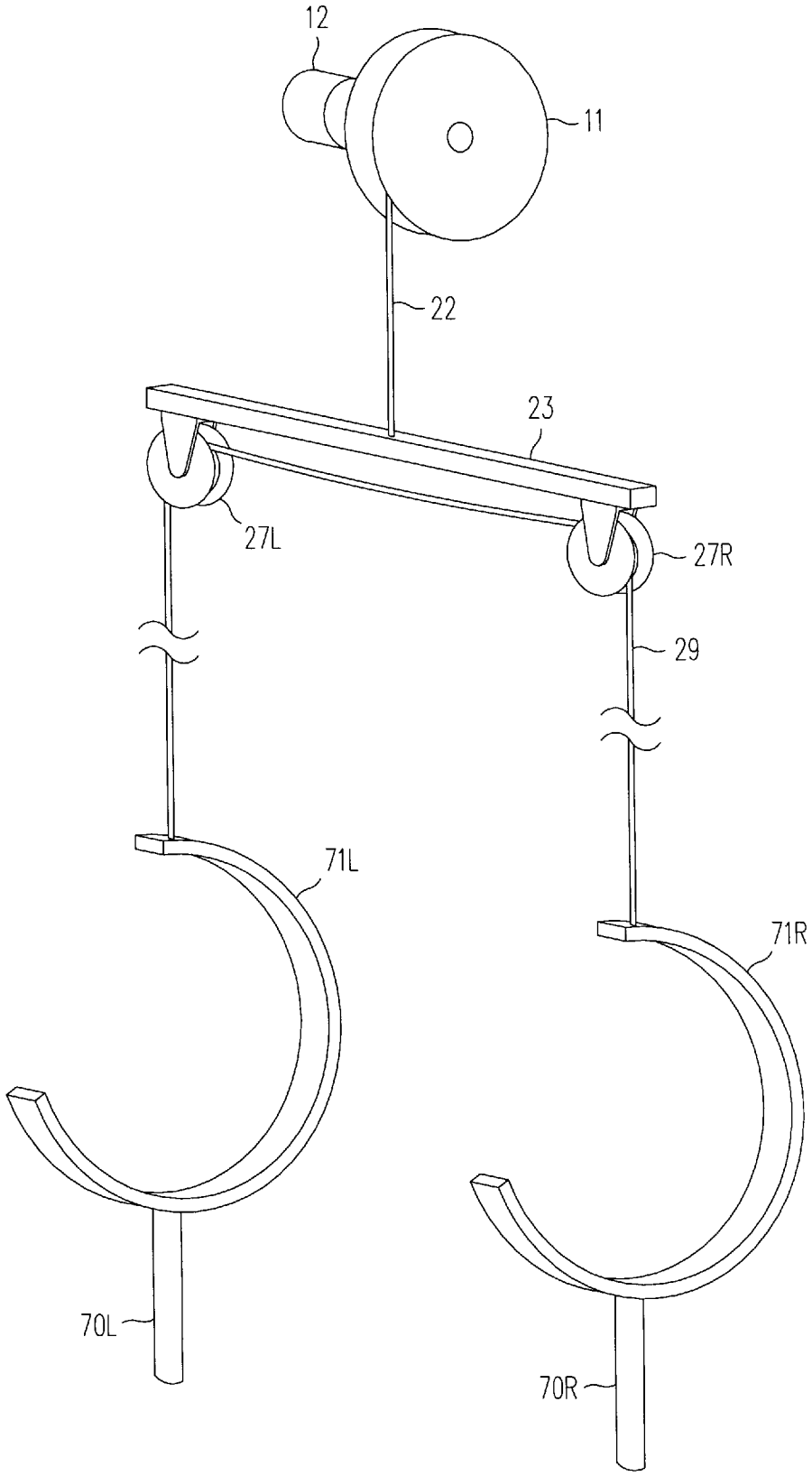
FIG. 7 illustrates a human power amplifier system with a pair of end-effectors which is designed to lift a human (e.g., a patient from a wheelchair).

FIG. 7 show a modified version of the system shown in FIG. 2, in which a pair of end-effectors 70L and 70R are connected to C-shaped members 71L and 71R for maneuvering patients from their wheelchairs to their beds and vice versa. C-shaped members 71L and 71R, which may be covered with a padded cushion, are to be placed under the patient's armpits. C-shaped members 71L and 71R are connected to bracket 62 of the end-effector.

In a second group of embodiments, the force imposed by the operator against the end-effector is measured by the displacement of the handle rather than a force sensor of the kind described above. The lower cost and ease of use of displacement measurement systems may make this type of end-effector more attractive in some situations.

Figure 8:
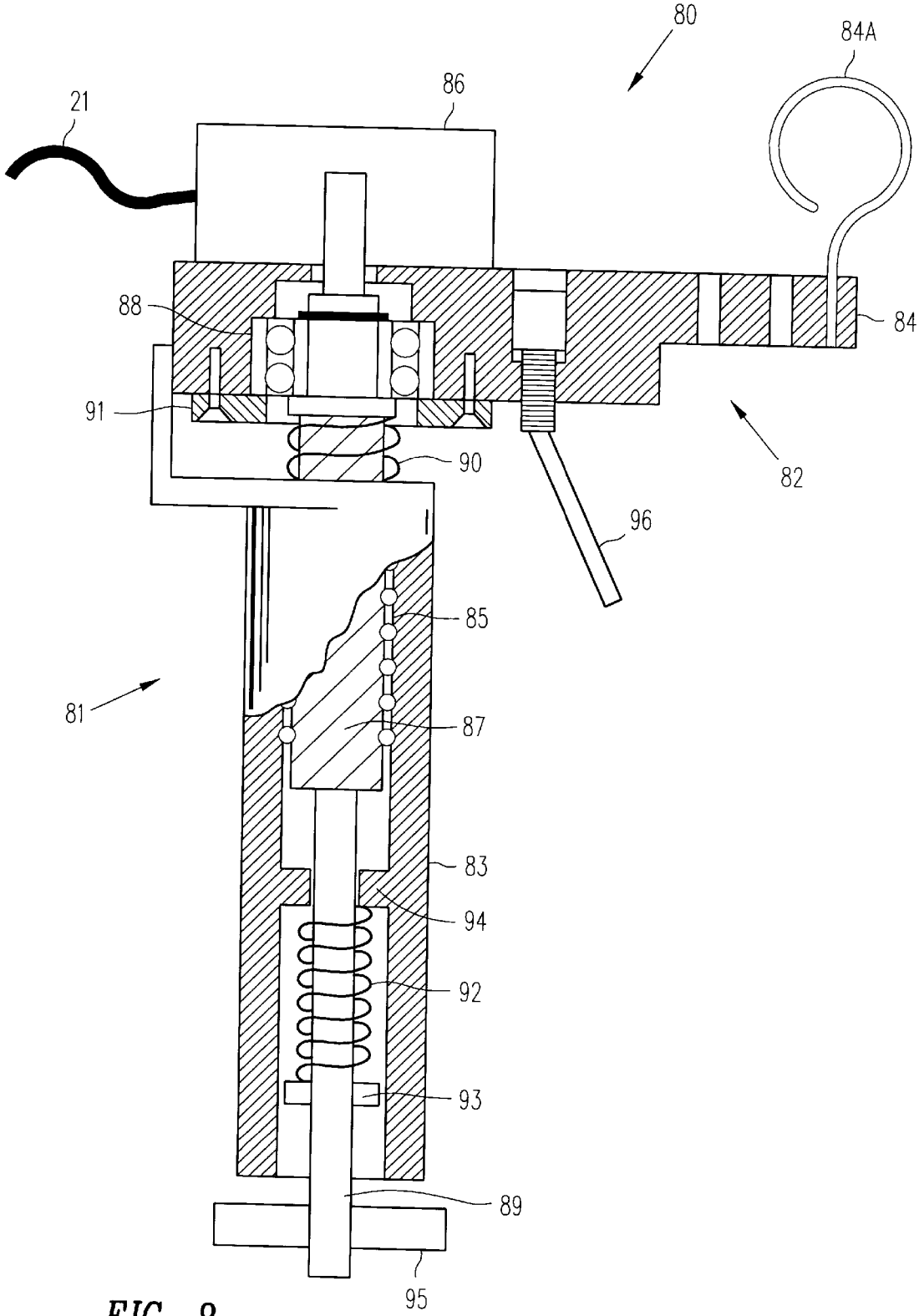
FIG. 8 illustrates a cross-sectional view of an embodiment of an end-effector which includes a displacement detector for measuring the force imposed on the end-effector by an operator.

A cross-sectional view of one embodiment of an end-effector of the second group is shown in FIG. 8. Similar to the end-effectors described above, end-effector 80 includes a human interface subsystem 81 and a load interface subsystem 82. Human interface subsystem 81 includes a handle 83 which is grasped by the operator and thus measures the human force, not the load force. Load interface subsystem 82 includes a bracket 84 that bolts to a hook or a suction cup or any other type of device that can be used to hold an object. An eyelet 84A is mounted in bracket 84 for connecting bracket 84 to a rope (not shown).

In end-effector 80 a ball-screw mechanism 85 translates the vertical displacement of handle 83 into a rotary displacement which is measured by an angle measuring device 86. Handle 83 functions as the ball-nut portion of ball-screw mechanism 85. The screw 87 of ball-screw mechanism 85 is secured by the inner race of a bearing system 88. Bearing system 88, here a double row bearing, includes of any combination of bearing(s) that allows rotation of screw 87 while supporting vertical and horizontal forces. A pair of angular contact bearings could also be used. Because of the connection between screw 87 and the inner race of bearing system 88, the inner race and screw 87 turn together. The outer race of the bearing system 88 is held in bracket 84 by a retaining ring 91 which is fixed to the bottom of bracket 84.

A shaft 89 extends from the lower end of screw 87 along the axis of handle 83. An upper coil spring 90 is positioned around screw 87 and between the upper end of handle 83 and retaining ring 91, and a lower coil spring 92 is positioned around shaft 89 between a stop 93 fixed to shaft 89 and a stop 94 formed in the interior of handle 83. Thus coil spring 90 urges handle 83 downward, and coil spring 92 urges handle 83 upward, and together springs 90 and 92 allow handle 83 to move axially with respect to screw 87 and shaft 89. A stop 95 mounted at the lower end of shaft 89 provides a limit to the downward movement of handle 83.

Handle 83, which functions as the ball-nut of the ball-screw mechanism 85, is held by the operator. If handle 85 is moved up and down without any rotation, then screw 87 turns. The amount of rotation of screw 87 depends on the lead of screw 87. For example, if the lead is ½", then for every ½" motion of handle 83, screw 87 turns one revolution.

Angle measuring device 86 connected to the top of bracket 84 measures the rotation of screw 87. Angle measuring device 86 can be an optical rotary encoder, a magnetic rotary encoder, a rotary potentiometer, a RVDT (Rotary Variable Differential Transformer), an analog resolver, a digital resolver, a capacitive rotation sensor or a Hall effect sensor. Angle measuring device 86 produces a signal proportional to the rotation of screw 87. Springs 90 and 92 return handle 83 to an equilibrium position when handle 83 is not pushed. As shown in FIG. 8, the spring pushes the ball-nut upward so the bracket stops the ball-nut.

To maintain a tension in the rope, an upward velocity is imposed on the rope when there is no load on the system (assuming that the end-effector itself is light). In this case, only one spring, a compression spring at the bottom of handle 83 or a tension spring at the top of handle 83, may be used to force handle 83 upward.

When using end-effector 80, the operator grasps handle 83. When the operator initiates an upward motion, handle 83 (the ball-nut) moves upward, causing screw 87 to turn (e.g., clockwise). This motion is recorded by angle measuring device 86. The generated signal from angle measuring device 86 is then transmitted to controller 20 (FIGS. 1 and 2). Actuator 12 turns pulley 11 appropriately, causing an upward motion of the rope and end-effector 80. This motion lifts the load and the end-effector 80 together. Similarly, when the operator initiates a downward motion, actuator 12 and the pulley 11 turn appropriately in the opposite direction, causing a downward motion of the rope and end-effector 80.

Thus, in end-effector 80 the vertical displacement of handle 83 relative to bracket 84 (which is proportional to the human force) is measured, and the measurement is fed to controller 20. Regardless of the type of displacement sensor used in this device and its installation procedure, this end-effector is designed to measure only the human force in the vertical direction. The end-effector does not measure the load force. A safety switch 96 is installed to transfer the actuator to another control mode (position control mode) or to turn the system off when the operator leaves the system.

Alternatively, ball-screw mechanism 85 in FIG. 8 can be replaced by a lead screw mechanism in which a sliding movement between a nut portion and a screw portion replaces the rolling motion of the balls. Preferably, there should be little friction between the nut portion and the screw portion, and the lead screw mechanism should be back drivable.

Figure 9:
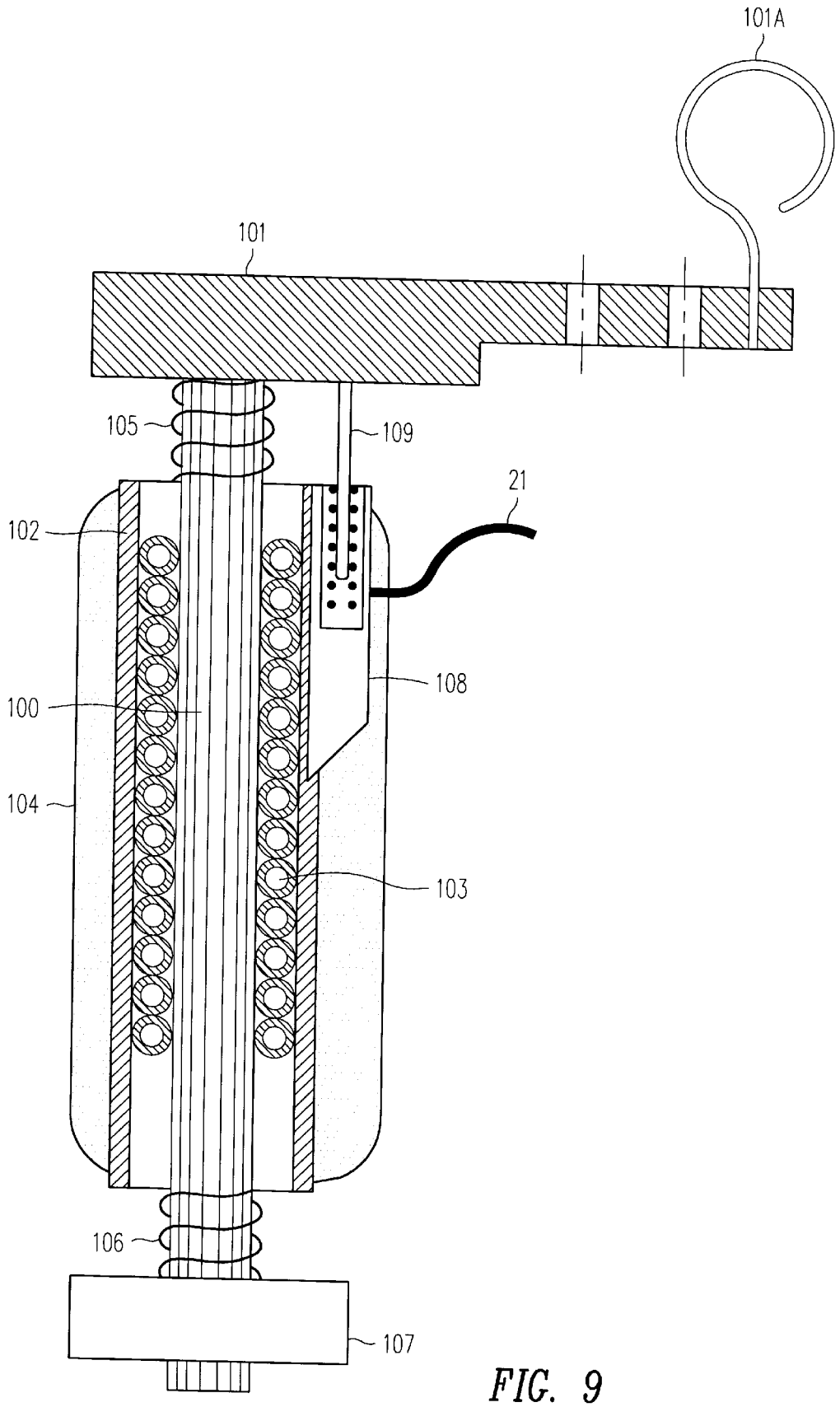
FIG. 9 illustrates a cross-sectional view of an alternative embodiment of an end-effector which includes a displacement detector for measuring the force imposed on the end-effector by an operator.

In this group of embodiments a variety of displacement sensors can be used to measure the spring deflection. FIG. 9 shows an end-effector in which the ball-screw mechanism is replaced with a ball spline shaft mechanism. A handle 102, which is in the ball-nut portion of the ball spline shaft mechanism, moves freely along a spline shaft 100, with no rotation relative to spline shaft 100. Balls 103 move in grooves on spline shaft 100. Handle 102 is held by the operator. A layer 104 of a foam like material can be included in handle 102, so that the operator can grab the handle more comfortably.

The right-hand side of bracket 101 is connected to a rope via an eyelet 101A and has hole patterns that allow for connection of a suction cup mechanism, a hook, or any device to hold the object. An upper coil spring 105 is positioned around spline shaft 100 between handle 102 and bracket 101 and urges handle 102 downward; similarly, a lower coil spring 106 is positioned around spline shaft 100 between handle 102 and a stop 107 and urges handle 102 upward. A linear motion detector 108 (e.g., a linear potentiometer or a linear encoder) contains a probe 109 which contacts bracket 101 so as to measure the motion of handle 102 relative to bracket 101. Linear motion detector 108 produces an electric signal on signal cable 19 which is proportional to the linear displacement of handle 102 relative to bracket 101.

Linear motion detector 108 can be an optical linear encoder, a magnetic linear encoder, a linear potentiometer, a LVDT (linear variable differential transformer), a capacitive displacement sensor, an eddy current proximity sensor or a variable-inductance proximity sensor. FIG. 9 shows a linear potentiometer having its housing connected to handle 102 and its probe 109 pushed against bracket 101. The motion of probe 109 relative to the potentiometer housing creates an electric signal proportional to the spring deflection.

Alternatively, the ball spline shaft mechanism shown in FIG. 9 can be replaced by a linear bushing mechanism, wherein a bushing (slider) and a shaft slide relative to one another with no balls. There should be little friction between the bushing (slider) and the shaft.

The sole purpose of the springs installed in the end-effector is to bring the handle back to an equilibrium position when no force is imposed on the handle by the operator. FIGS. 8 and 9 show the end-effector using compression springs. One can use other kinds of springs, such as cantilever beam springs, tension springs or belleville springs in the end-effector. Basically, any resilient element capable of bringing the handle back to its equilibrium position will be sufficient. The structural damping in the springs or the friction in the moving elements of the end-effectors (e.g. bearings) provide sufficient damping in the system to provide stability.

Although not shown in the figures, one can install one or several switches on the end-effectors described herein to transfer the actuator to another control mode (position control mode) or to turn the system off when the operator leaves the system. A position controller freezes the actuator and consequently the end-effector at the position where it is when the operator leaves the system.

As described above, the force or displacement sensor in the end-effector delivers a signal to controller 20 which is used to control actuator 12 and to apply an appropriate torque to pulley 11. If e is the input command to actuator 12 then, in the absence of any other external torque on the actuator, the linear velocity of the outermost point of the pulley or the rope (v) can be represented by:

$$V=G\cdot e \tag{1}$$

where G is the actuator transfer function. In addition to the input command (e) from the controller, the forces imposed on the end-effector also affect the rope velocity. There are two forces imposed on the end-effector which affect the rope velocity: a force ($f_R+f_L$) which is imposed by the operator's right hand and left hand, and a force (p) which is imposed by the load on the end-effectors (see FIG. 2). The input command (e) and the forces on the end-effectors contribute to the actuator speed such that:

$$v=G\cdot e+S(f_R+f_L+p)-V_{UP} \tag{2}$$

where S is the actuator sensitivity function which relates the external forces to the rope velocity (v). S is defined as the downward velocity of the rope (or linear velocity of the outermost point on the pulley) generated if one unit of impulse tensile force is imposed on the rope. If a velocity controller is designed for the actuator so that S is small, the actuator has only a small response to the imposed tensile force on the rope. A high-gain controller in the closed-loop velocity system results in a small S and consequently a small change in actuator velocity in response to forces imposed on the rope. Also note that a high ratio transmission system on the actuator produces a small S for the system. Note that ($f_R+f_L+p$) is the total tensile force in rope 13 assuming bar 23 has negligible mass in comparison with the other forces. To develop tension in ropes 13, 22 and 29 (FIGS. 1 and 2) at all times, an upward biased rope velocity ($V_{UP}$) is introduced to the system.

A reasonable performance specification for the actuator is the level of amplification of the human force ($f_R+f_L$) that is applied to the end-effector. If the force amplification is large, a small force applied by the operator results in a large force being applied to the load via the rope. If the force amplification is small, a small force applied by the operator results in a small force being applied to the load via the rope. Consequently, if the force amplification is large, the operator "feels" only a small percentage of the force required to lift the load. Importantly, the operator still retains a sensation of the dynamic characteristics of the free mass, yet the load essentially "feels" lighter. With this heuristic idea of system performance, the system performance can be defined as a number that is referred to as the force amplification factor. For example, when the force amplification factor of the system is programmed to be 5, the force on the end-effector from the load is 5 times the force that the operator is applying to the end-effector. The following explains how to guarantee this for the amplifier. The human forces $f_R$ and $f_L$ are measured and passed through controller 20, which delivers a signal (e) to actuator 12. If the transfer function of the controller is represented by K, then the output of the controller, e, is equal to $K(f_R+f_L)$.

Substituting for e in equation (2) results in the following equation for the rope velocity (v):

$$v=GK(f_R+f_L)+S(f_R+f_L+p)-V_{UP} \tag{3}$$

Now suppose that the operator maneuvers two different objects through similar trajectories. Since the object weights are different from each other in these two experiments, then the resulting force that the operator experiences during each maneuver will be different. Any change in the force from the load on the end-effector due to variation of the object mass ($\Delta p$) will result in a variation of the human force according to the following equation if no change in maneuvering speed is expected:

$$\left(\frac{GK}{S}+1\right)(\Delta f_R+\Delta f_L)=-\Delta p \tag{4}$$

where $Df_L$ and $Df_R$ are the change in the human force on the end-effector.

Figure 10:
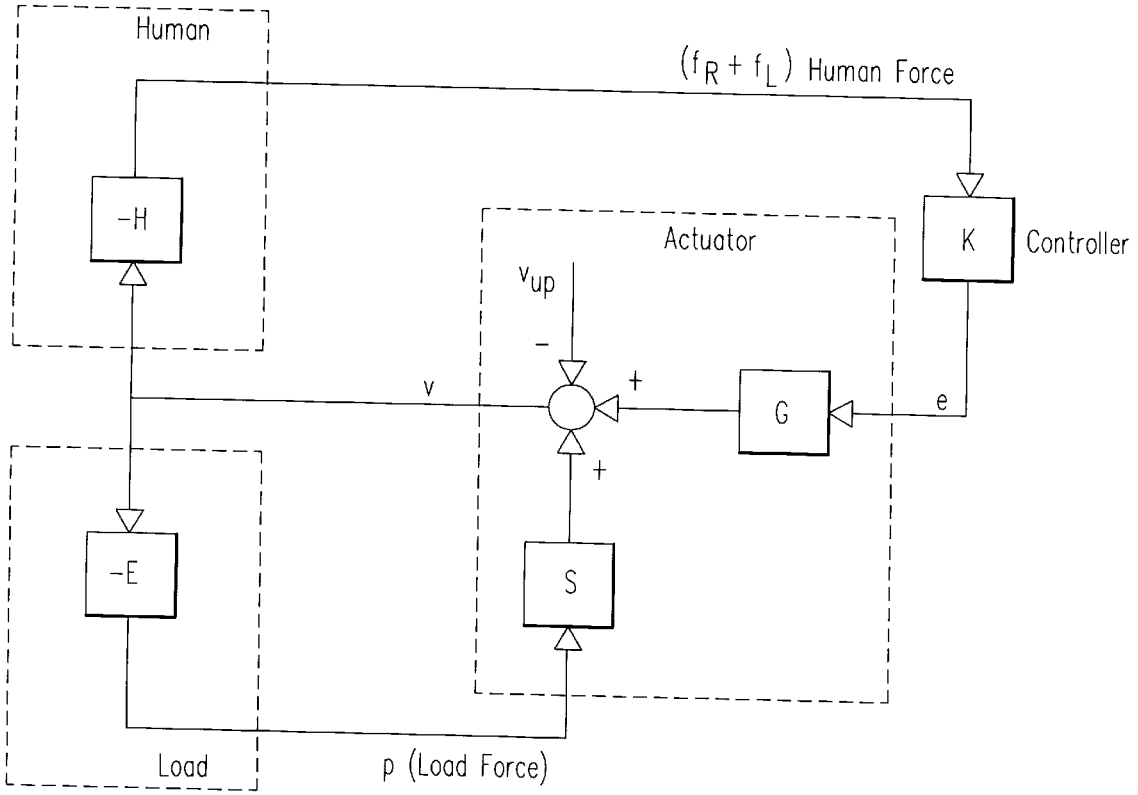
FIG. 10 illustrates a schematic diagram of the manner in which the operator and load forces interact with the elements of the human power amplifier to provide a movement to a load.

The term (GK/S+1) in equation (4) is the force amplification factor. This term relates the change in the load force ($\Delta p$) to the change in the human force ($\Delta f_R+\Delta f_L$). The larger K is chosen to be, the greater the force amplification in the system. K must be designed to yield an appropriate force amplification. FIG. 10 shows diagrammatically how the human force and load force are generated. As FIG. 10 indicates, K may not be arbitrarily large. Rather, the choice of K must guarantee the closed-loop stability of the system shown in FIG. 10. The human force ($f_R+f_L$) is a function of human arm impedance (H), whereas the load force (p) is a function of load dynamics (E), i.e. the gravitational and inertial forces generated by the load.

As described above, the device in FIG. 2 allows the operator not only to lift, but also to rotate the object. The torque required to rotate the object is delivered entirely by the human without any assistance from the device. Therefore, although the device shown in FIG. 2 allows for small rotational maneuvers of the object, highly accelerated rotations of the object are not recommended. Similarly, lifting objects with an uneven weight distribution requires torque which must be supported by the human entirely and is not recommended. In summary, the operator must make sure that the weight of the object being lifted is in the middle of the end-effectors. Moreover, if needed, the objects must be rotated with very little acceleration. It can easily be understood that under the above assumption, the human forces on both end-effectors are equal to each other: i.e. $f_R=f_L$ and equation (4) reduces to $$\left(\frac{2GK}{S}+2\right)\Delta f_R=-\Delta p \tag{5}$$

The above equation is also true for the left end-effector.

As described above, in the operating with two end-effectors one can install a force sensor on one of the end-effectors only. If only the right end-effector has a force sensor, then the analysis (similar to the analysis above) reduces to:

$$\left(\frac{GK}{S}+2\right)\Delta f_R=-\Delta p \tag{6}$$

This indicates, for a given K, the force amplification when only one end-effector is instrumented is smaller than the force amplification when both end-effectors are instrumented.

Note that if the system operates as shown in FIG. 1 (i.e. one end-effector only), then equation (4) reduces to:

$$\left(\frac{GK}{S}+1\right)\Delta f_R=-\Delta p \tag{7}$$

Thus the end-effector electronically senses the force from the human hand gripping the end-effector. The measurement of the hand force is transmitted to the device's controller. Using this measurement, the controller calculates the amount of pulley rotation necessary to either raise or lower the pulley rope the correct distance to create enough mechanical strength to assist the operator in the lifting task. In this way, the end-effector follows the human arm motions in a "natural" way. In other words the pulley, the rope, and the end-effector mimic the lifting/lowering movements of the human operator, and the human is able to manipulate heavy objects more easily without the use of any intermediary device.

The rope supports only a pre-programmed proportion of the load forces (i.e., gravity plus inertial force due to acceleration), not the entire load force; the remaining force is supported by the operator. This method of load sharing gives the operator a sense of how much he/she is lifting. This is true because the force the human is imposing on the end-effector is exactly equal to a scaled-down value of the actual force the load is imposing on the rope. The measured signal from the end-effector, a signal representing the human force, is used via a computer or electronic circuitry to drive the actuator appropriately so that only a pre-programmed small proportion of the load force is lifted by the operator. Therefore the actuator adds effort to the lifting task only in response to the operator's hand force. For example, if the human force is set to be 5% of the actual force needed to lift the load, for every 50 lbs. of force (gravity plus inertia force due to acceleration) the pulley rope could supports 45 lbs. while the operator feels and supports 5 lbs. The allocation of the load forces between the pulley rope and the human is programmable.

Another group of embodiments according to this invention include a highly versatile pneumatic human power amplifier module that can be used with a wide variety of pneumatic material handling systems. The pneumatic human power amplifier module in effect converts a conventional pneumatic material handling system into a human power amplifier system. Four illustrative arrangements are shown in FIGS. 11–14. In each of these embodiments the pneumatic human amplifier module generally includes an end-effector, an electronic controller and a pneumatic circuit comprising a proportional servovalve and an optional directional servovalve.

In existing manual material handling devices, a simple pneumatic circuit with two manual valves (usually thumb-operated), one for upward motion and one for downward motion, lets air into and out of the actuator for lifting and lowering the load. Such manual operation with up/down valves is not natural for the operator, because the operator is busy operating a valve or a switch and is not in physical contact with the load being lifted. Thus the operator does not have any sense of how much he/she is lifting. With existing manual material handling devices, the operator must concentrate on operating the valves to achieve a desired lifting speed for the load. But, when the human amplifier module described here is part of the device, the operator no longer has to use manual valves to operate the device.

Figures 11, 11A:
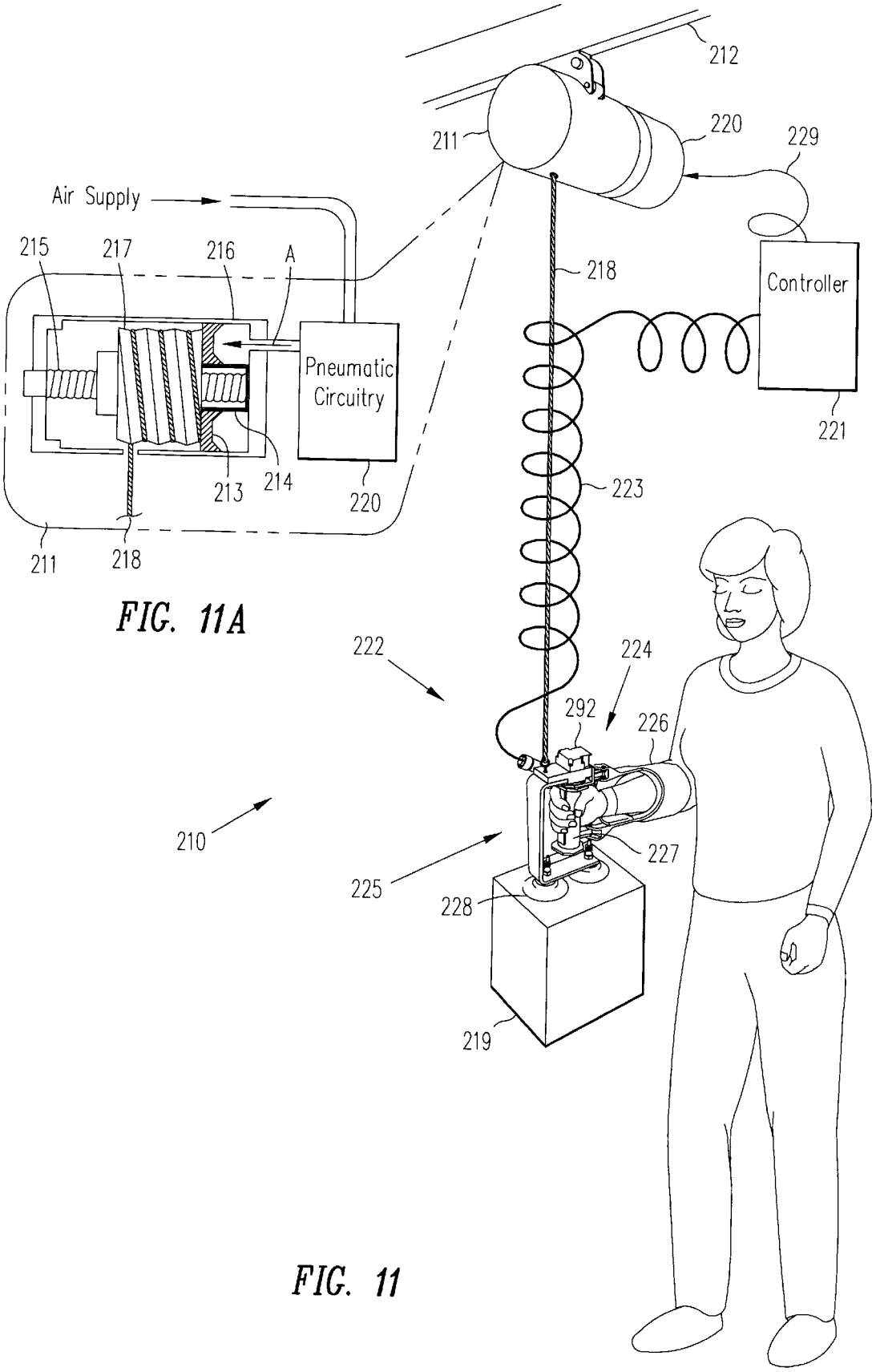
FIG. 11 is a perspective view of a pneumatic human power amplifier module according to this invention arranged so as to control a ceiling-hung pneumatic material handling device containing a single-acting translational actuator.
FIG. 11A is a cutaway side view of the single-acting transational pneumatic actuator shown in FIG. 11, showing the internal pulley, ball-nut, ball-screw and piston.
Figure 15:
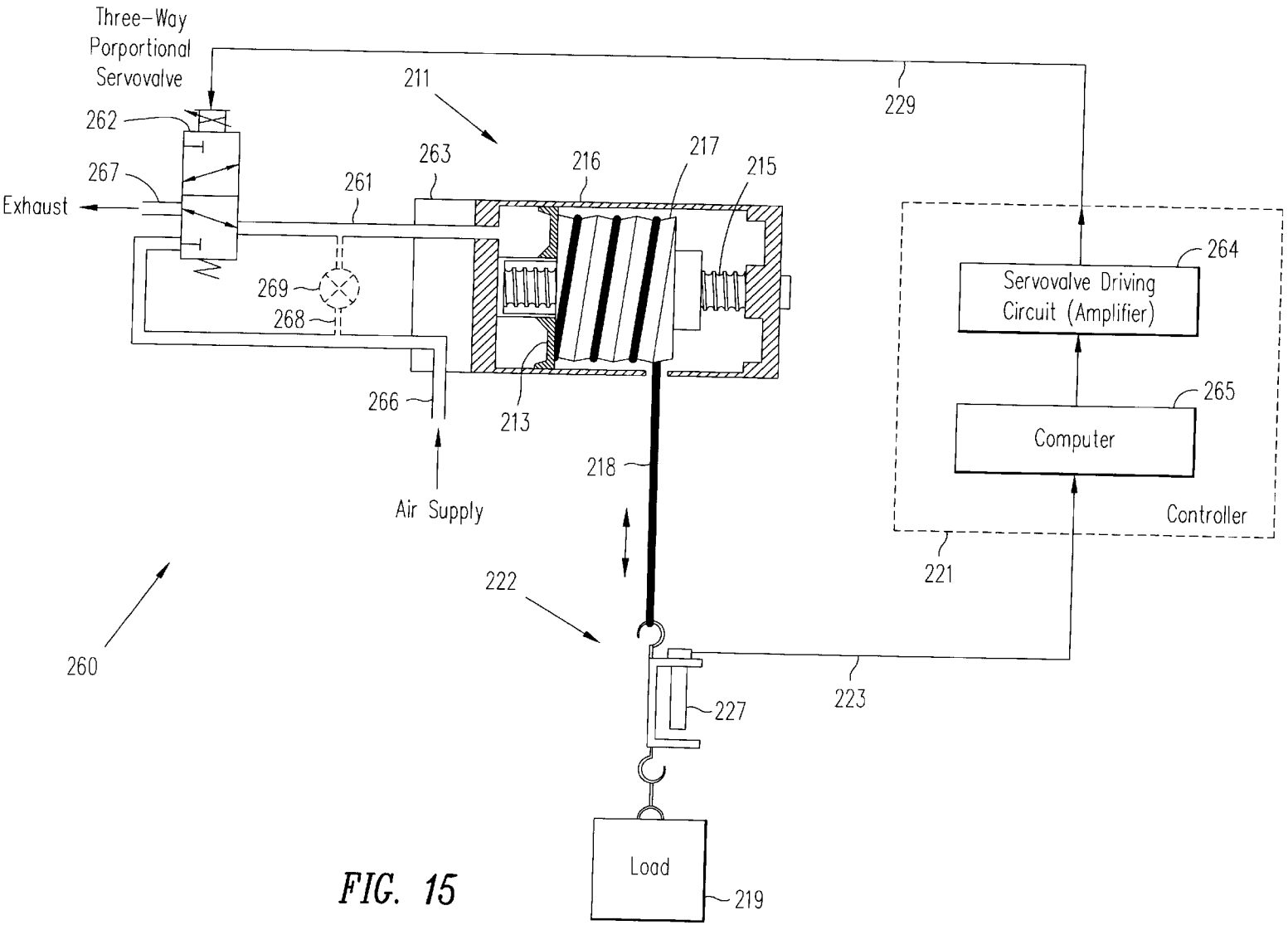
FIG. 15 is a schematic diagram showing a pneumatic circuit without manual override
Figure 16:
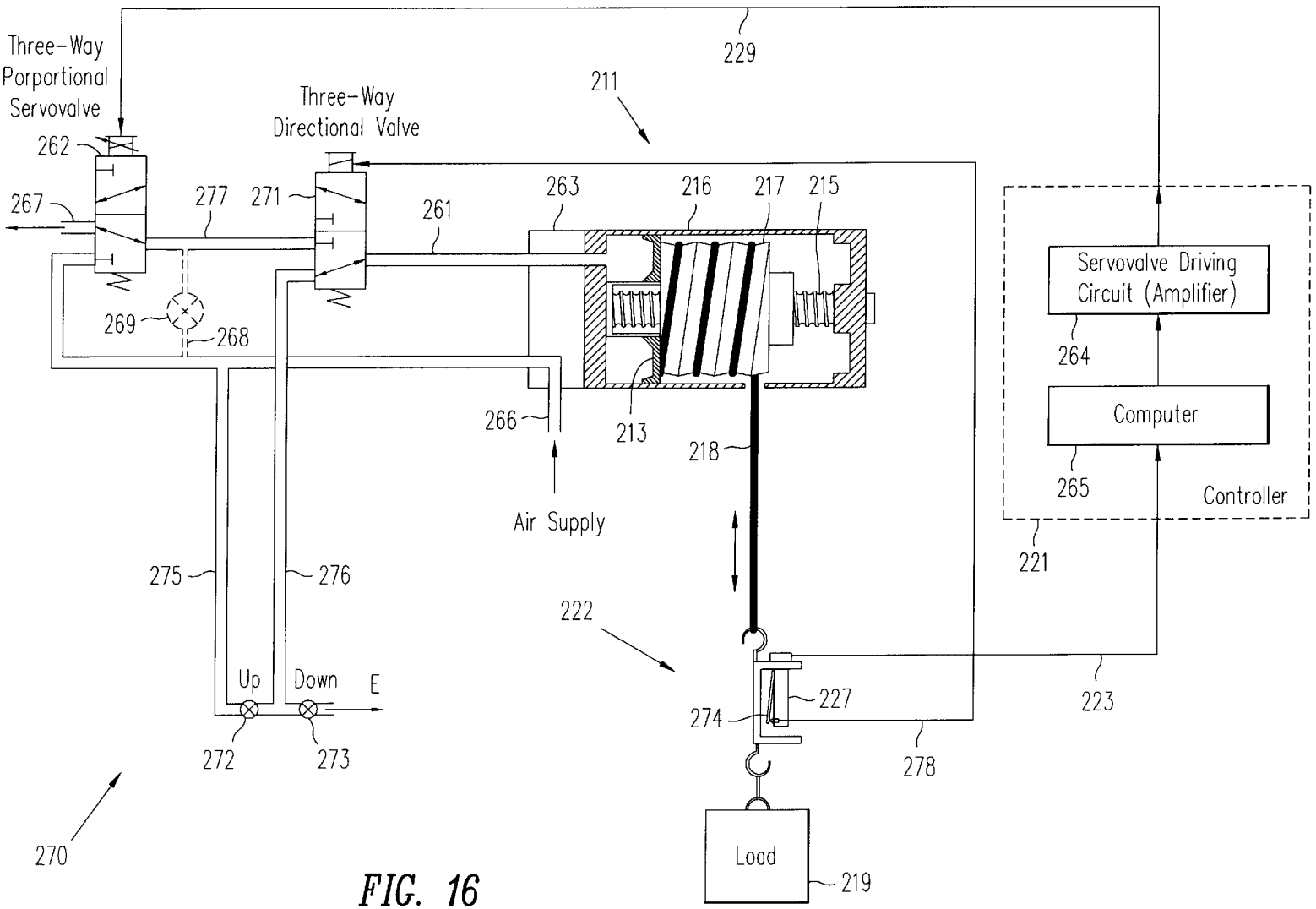
FIG. 16 is a schematic diagram showing a pneumatic circuit with manual override

FIGS. 11 and 11A illustrate the use of the pneumatic human power amplifier module on a manual material handling device 210. Manual material handling device 210 includes a pneumatic single-acting translational actuator 211 mounted horizontally on a structural support such as a ceiling or on an overhead crane 212. The piston 213 of actuator 211 is connected to a ball-nut 214 of a ball-screw mechanism. The screw 215 of the ball-screw mechanism is stationary and fixed to the cylinder 216 of the actuator 211. The ball-nut 214 carries a winch 217. As supply air is pushed into the cylinder 216 of the pneumatic translational actuator 211, the winch 217 rotates with the ball-nut 214 due to the force of the air (arrow A) on the face of the piston 213. The rotation of winch 217 winds or unwinds the rope 218 and causes the rope 218 to lift or lower the load 219 connected to the rope 218. Although it could be mounted at any location, the pneumatic circuitry 220 is mounted on the actuator 211 for convenience and compactness. The details of the pneumatic circuitry 220 are shown in FIGS. 15 and 16.

The servovalves located in the pneumatic circuitry 220 are controlled by the electronic controller 221 which receives control signals from the end-effector 222 over a signal cable 223. The controller 221 can be an analog circuit, a digital circuit, or a computer with electronic input/output capability.

Instead of the manual valves used in existing material handling devices, the human operator controls device 210 with the end-effector 222 that is attached to the endpoint of the rope 218. The end-effector 222 has two subsections: the human interface subsection 224 and the load interface subsection 225. The human interface subsection 224 includes a brace 226 that the operator wears, a handle 227 that the operator grasps, and a force-sensing device 292 that measures the force of the operator's hand on the handle 227. The load interface subsection 225 includes components such as suction cups or hooks that attach to the load 219. Two suction cups 228 are used in this application. The air circuitry for the suction cups 228 and the logic switches for controlling the vacuum for cups 228 are not shown for the sake of clarity.

The end-effector 222 contains a sensor which measures the magnitude of the vertical force exerted on the handle 227 of the end-effector 222 by the human operator's hand. Signals representing the forces from the operator's hand are transmitted to the controller 221 over signal cable 223. Using these signals, the controller 221 calculates the correct amount that a proportional servovalve included in the pneumatic circuitry 220 has to open to allow air to flow to or from the actuator 211. The command from the controller 221 to this pneumatic circuitry is carried by signal cable 229. The resulting motion of the piston 213 due to this air flow rotates the winch 217 enough to either raise or lower the rope 218 the correct distance that creates enough mechanical strength to assist the operator in the lifting task as required. All of this happens so quickly that the operator's lifting efforts and the device's lifting efforts are for all purposes synchronized perfectly. If the operator's hand pushes downward on the handle 227 and brace 226, the winch 217 rotates and moves the rope 218 downward, lowering the load 219. If the operator's hand pushes upward on the handle 227 and brace 226, the winch 217 rotates (in the opposite direction) and the rope 218 moves upward, lifting the load 219. The operator's physical movements are thus translated into a physical assist from the machine 210, and the machine's strength is directly and simultaneously controlled by the human operator's force on the handle 227. In summary, the load 219 moves vertically because of the vertical movements of both the operator's hand and the material handling device 210.

Figure 12:
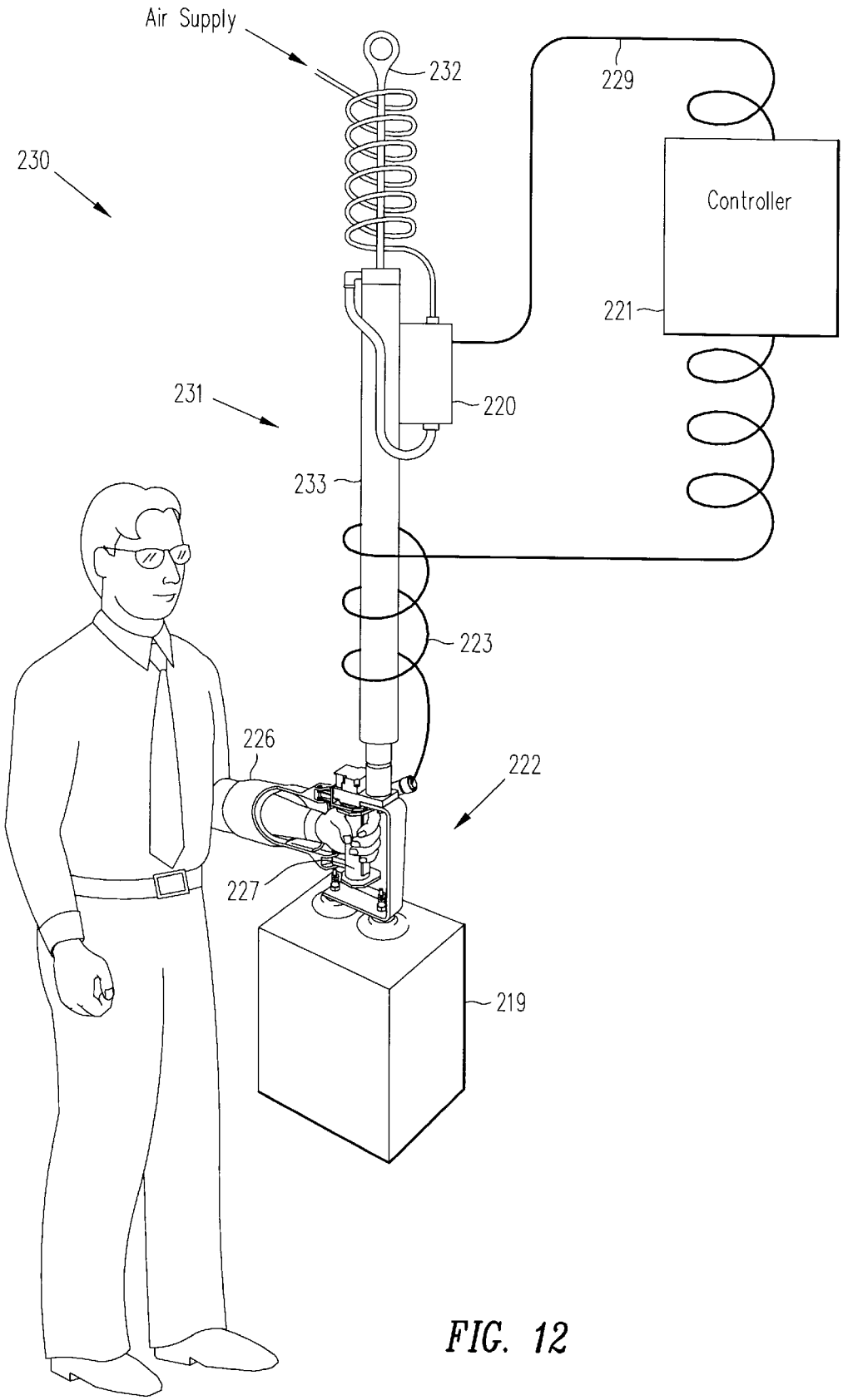
FIG. 12 is a perspective view of the pneumatic human power amplifier module arranged so as to control a ceiling-hung pneumatic material handling device containing a different form of single-acting translational actuator.
Figure 13:
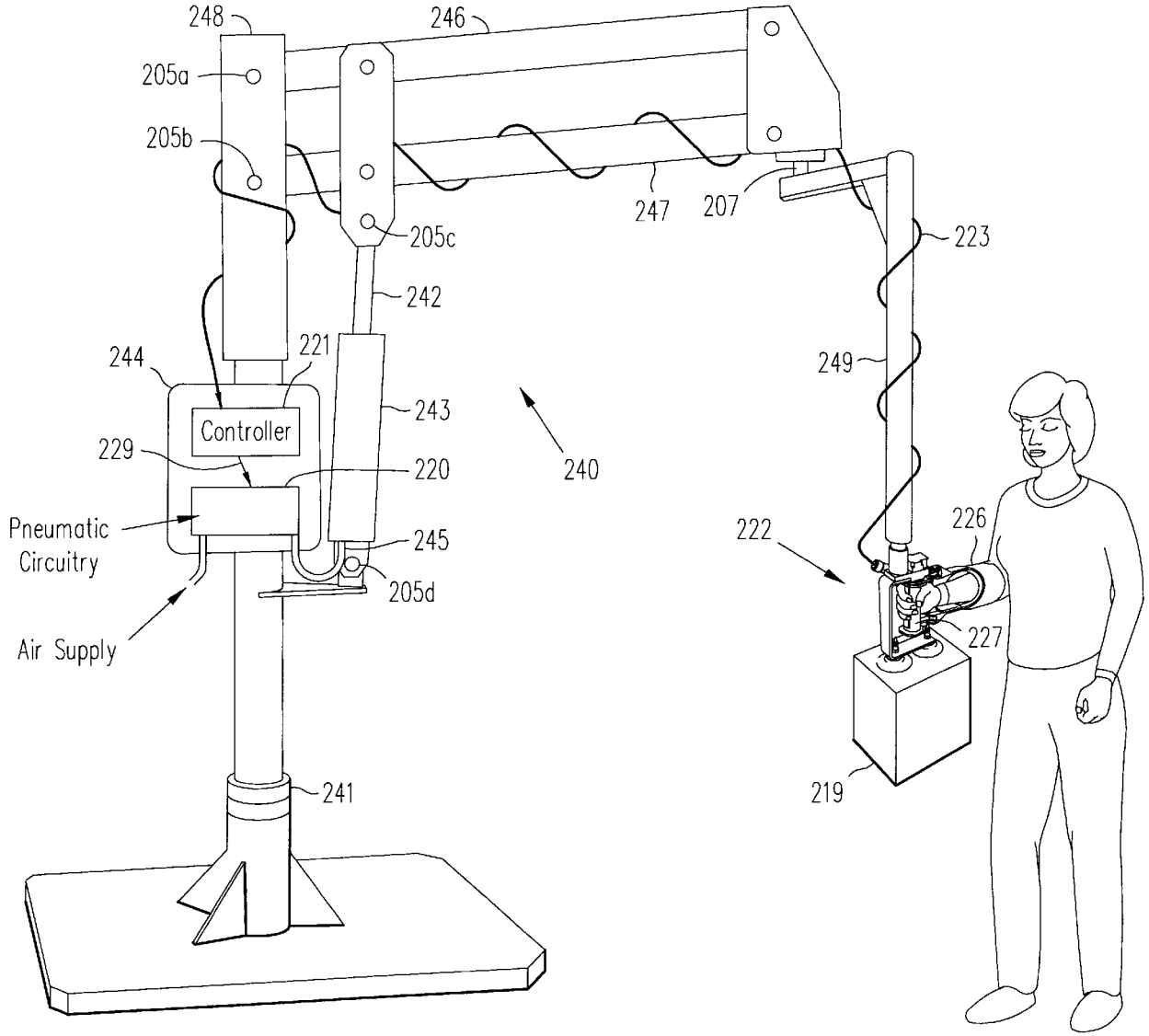
FIG. 13 is a perspective view of the pneumatic human power amplifier module arranged so as to control a pedestal-mounted multi-degree-of-freedom pneumatic material handling manipulator containing a single-acting translational actuator.
Figure 14:
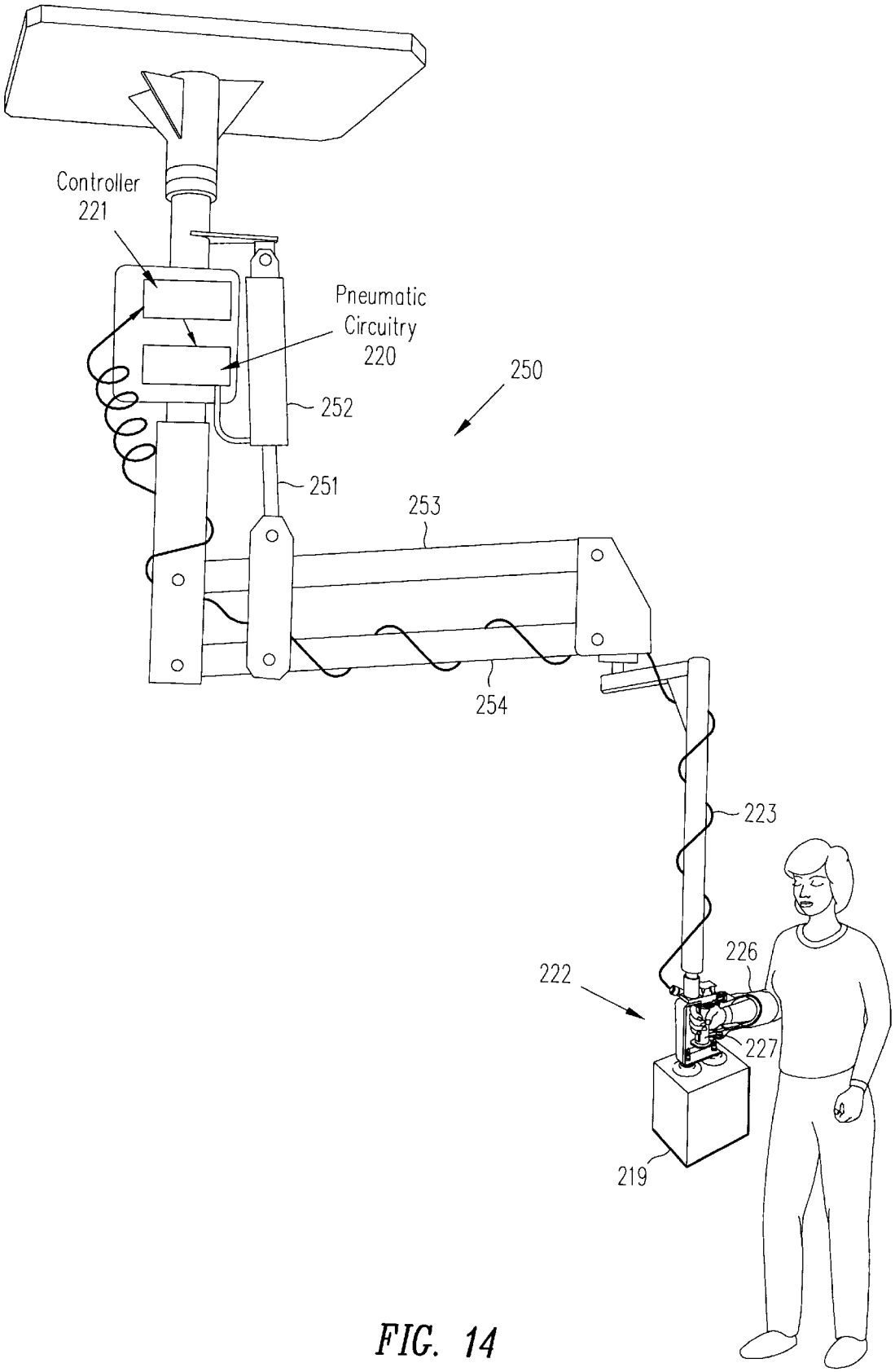
FIG. 14 is a perspective view of the pneumatic human power amplifier module arranged so as to control a ceiling-hung multi-degree-of-freedom pneumatic material handling manipulator containing a single-acting translational actuator.

The three embodiments illustrated in FIGS. 12–14 show how the pneumatic human power amplifier module can be used in conjunction with other types of pneumatic material handling devices. FIG. 12 shows the pneumatic human power amplifier module connected to a material handling device 230 which includes a pneumatic single-acting translational actuator 231 hung by its piston side 232 from a ceiling or overhead crane (not shown). The pneumatic human power amplifier module includes the same components as the module shown in FIG. 11, i.e., the end-effector 222, the pneumatic circuitry 220, and the electronic controller 221. When air is pushed into the cylinder 233 of the actuator 231, the cylinder 233 and the load 219 will move upward. Like the system of FIG. 11, material handling device 230 adds power to the movement of the load 219 only in the vertical direction. Because the human amplifier module is a part of the material handling device 230, the operator no longer has to use manual valves to operate the device 230 in order to lift loads. Instead, he/she controls the device 230 with the end-effector 222 that is attached to the endpoint of the device 230. The actuator 231 is driven by pneumatic circuitry 220 (mainly a proportional servovalve and a directional servovalve) that is controlled by an electronic controller 221. The electronic controller 221 can be an analog circuit, a digital circuit, or a computer with electronic input/output capability. The controller 221 receives signals from the end-effector 222 over a signal cable 223. Similar to the device shown in FIG. 11, the controller 221, based on measured signals from the end-effector 222 and based on the dynamic behavior of the system, calculates how much to open the proportional servovalve. This causes the actuator 231 to move as necessary to either raise or lower the end-effector 222 and the load 219 the correct distance that creates enough mechanical strength to assist the operator in the lifting task. If the operator's hand pushes upward on the handle 227 and brace 226, the actuator 231 lifts the load 219 upward. If the operator's hand pushes downward on the handle 227 and brace 226, the actuator 231 moves the load 219 downward. Therefore the load 219 moves vertically because of the vertical movements of both the operator and the material handling device 230.

FIG. 13 illustrates a further embodiment of the invention where a pneumatic human power amplifier module is used in conjunction with a manual material handling manipulator 240 that is mounted on a pedestal 241. Again, the pneumatic human power amplifier module includes pneumatic circuitry 220, electronic controller 221, and end-effector 222. Unlike the previous applications, material handling manipulator 240 manipulates loads in all directions, even though it is usually powered only in the vertical direction to compensate for gravity forces. Thus, only one degree of freedom of the manual material handling manipulator 240 is powered by the pneumatic single-acting translational actuator which includes piston 242 and cylinder 243. In this case both the pneumatic circuitry 220 and the controller 221 are enclosed in a box 244. Attached to the endpoint of the manipulator 240 is an end-effector 222. The handle 227 of the end-effector 222 is gripped by the human operator's hand and contains a force sensor which measures the force that the operator applies to the handle 227 in the vertical direction. Using these measurements, via signal cable 223, the controller 221 calculates how much to open the proportional servovalve within pneumatic circuitry 220 to add sufficient power to assist the operator in the lifting task. A lifting mechanism includes horizontal links 246 and 247, which pivot about points 205*a* and 205*b* on a vertical member 248. Piston 242 and cylinder 243 are attached to pivot points 205*c* and 205*d*, respectively. If the operator's hand pushes upward on the handle 227 and arm brace 226, air is pushed through the servovalve (inside box 244) and hose 245 into cylinder 243. The actuator (consisting of piston 242 and cylinder 243) expands, and the horizontal pivoting links 246 and 247 are pushed upward by the upward force of the piston 242. If the operator's hand pushes downward on the handle 227 and brace 226, the actuator retracts and links 246 and 247 move downward. The controller 221 can be an analog circuit, a digital circuit, or a computer with electronic input/output capability. A vertical beam 249 from which the end-effector 222 is supported is rotatable about a pivot point 207 to allow the load 219 to be moved in a horizontal plane.

Yet another embodiment of the invention is shown in FIG. 14. In this case, the human amplifier module system is mounted on a material handling manipulator 250. Material handling manipulator 250 is similar to material handling manipulator 240 (FIG. 13), except that material handling manipulator 250 is hung from the ceiling or from an overhead crane. The end-effector 222 mounted at the endpoint of manipulator 250 measures the human operator's force on the end-effector 222. Using these measurements, the controller 221 calculates the degree to which the servovalve within pneumatic circuitry 220 needs to open in order to cause the actuator (including piston 251 and cylinder 252) to create enough mechanical force to assist the operator in the lifting task. If the operator's hand pushes upward on the handle 227, the actuator contracts and links 253 and 254 move upward. If the operator's hand pushes downward on the handle 227, the actuator expands and links 253 and 254 move downward.

Three elements of the pneumatic human power amplifier module, namely, the pneumatic circuitry 220, the end-effector 222, and the controller 221 will now be described. Two versions of pneumatic circuitry 220, one without and one with manual override control, are seen in FIGS. 15 and 16.

A pneumatic circuit 260 without manual override control is shown in FIG. 15. Circuit 260 can be used with any of the material handling devices shown in FIGS. 11, 12, 13, and 14. The manual material handling system 210 depicted in FIG. 11 is used to describe pneumatic circuit 260. The single-acting pneumatic actuator 211 is used to lift/lower load 219 with rope 218. The piston 213 in single-acting actuator 211 can be pushed in only one direction, because actuator 211 has only one port 261 for air flow. As discussed above, the movement of the piston 213 translates into the rotation of winch 217 due to the ball-screw mechanism. The air supply, which is regulated by a pressure regulator at a relatively constant pressure (usually about 100 psi but in a range of from about 70 psi to about 120 psi), is sent to a three-way proportional servovalve 262. The air supply flows through the manifold 263 that is attached to the actuator 211 for the sake of compactness. The proportional servovalve 262 controls the flow of air into and out of the actuator 211 based on an electronic signal from a servovalve driving circuit (amplifier) 264 which is carried over the signal wire 229. The air flow between the proportional servovalve 262 and the actuator 211 is controlled by the computer 265 which provides an input command to the servovalve driving circuit (amplifier) 264. For example, when the voltage command from the computer 265 to the servovalve driving circuit (amplifier) 264 is 5 volts, the proportional servovalve 262 allows air to flow from the air supply port 266 to the actuator port 261; and when the voltage command is −5 volts, the proportional servovalve 262 allows air to flow from the actuator port 261 to the exhaust port 267 of the servovalve. Note that the above arrangement lets air flow in both directions, into and out of the actuator 211 through actuator port 261. The air flow at any voltage command between −5 volts and 5 volts is a linear function of the voltage command to the valve driving circuit 264, with the air flow from air supply port 266 to the actuator port 261 increasing linearly as the voltage increases from 0 to 5 volts, and with the air flow from actuator port 261 to the exhaust port 267 increasing linearly as the voltage decreases from 0 to −5 volts. Of course, at a particular voltage command from the computer 265 (zero volt in this example) there is no air flow in actuator port 261. As the proportional servovalve 262 opens the flowpath from air supply port 266 to the actuator port 261, the air flow into the actuator 211 increases, which moves the piston 213 to the right. As the proportional servovalve 262 opens the flowpath from the actuator port 261 to the exhaust port 267, the air in the cylinder 216 is allowed to vent. This causes the weight of the load 219 to turn the winch 217 and moves the piston 213 to the left. An optional passage 268 including a manual valve 269 can be installed in parallel with the proportional sevovalve 262 to provide a biased flow into the actuator 211 if the proportional servovalve is not able to provide such a biased flow. A small opening of valve 269 allows for an upward bias force on cable 218. The technique for generating the control signal to the servovalve driving circuit (amplifier) 264 is described below.

In one embodiment, proportional servovalve 262 is the model NVEF, and servovalve driving circuit (amplifier) 264 is the model VEA, both of which are available from SMC Inc. There are two kinds of servovalves available in the market: flow control proportional servovalves and pressure control proportional servovalves. Although in the above description proportional servovalve 262 is a flow control servovalve, a pressure control servovalve could be used in place of the flow control servovalve.

The pneumatic circuit shown in FIG. 15 does not include a back-up system to allow manual maneuvering of the load 219 without the end-effector 222. In other words, there is no pushbutton, keyboard, switch, or manual valve for operating the actuator 211 in case of an electric power failure or the malfunctioning of the computer 265, end-effector 222 or servovalve driving circuit 264. To remedy this problem, manual override air circuitry can be added to the automated circuit of FIG. 15. FIG. 16 shows an enhanced pneumatic circuit 270 that incorporates the manual override mode. Pneumatic circuit includes a three-way directional servovalve 271 and two normally-closed, usually thumb-operated "Up" 272 and "Down" 273 valves. Directional servovalve 271 may be a model NVS valve available from SMC Inc. In this system, the flow from the air supply port 266 is directed to one of two circuits by directional servovalve 271, which is controlled by a momentary deadman switch 274 on the end-effector 222. Note that FIG. 16 shows the three-way directional servovalve 271 in its normal position, that is, when it is not activated electrically by the deadman switch 274. When the three-way directional servovalve 271 is not activated, the air is directed through the manual control portion of the circuit, allowing the operator to use the manual "Up" 272 and "Down" 273 valves. This occurs in two situations: either when the electric power fails or when the operator is not holding onto the end-effector 222. In either case the system turns to manual mode and the operator will be able to operate the device manually. In this manual mode when the operator activates the "Up" valve 272, the air flows from the air supply port 266, through the hose 275, through the "Up" valve 272, through the hose 276, through the three-way servovalve 271, and through passage 261 to the actuator 211. This moves the piston 213 to the right and lifts the load 219. When the operator activates the "Down" valve 273, the weight of the load 219 causes the pulley 217 to turn and move the piston 213 to the left and lower the load 219. The air in the actuator 211 is then exhausted through the three-way directional servovalve 271, through the hose 276, and through the "Down" valve 273, to the atmosphere (arrow E).

If the deadman switch 274 is depressed, (i.e., the operator is holding onto the handle 227 of the end-effector 222), the three-way directional servovalve 271 is activated and hose 277 will be connected to the actuator 211, bypassing the manual circuitry. The proportional servovalve 262 then controls the flow of air into and out of the actuator 211 based on the signal from the controller 221 which is carried by signal wire 229. In other words, once the deadman switch 274 is activated, the system operates in the same manner as the system shown in FIG. 15, and the operator's activation of the "Up" 272 or "Down" 273 valves will have no effect on the system behavior.

FIG. 16 shows that the three-way directional servovalve 271 is activated directly by the signal coming from the deadman switch 274 via the signal wire 278. However there are other ways to activate the three-way directional servovalve 271 which will produce the same performance. For example, the three-way directional servovalve 271 can be activated indirectly by the deadman switch 274 via a relay. In such an embodiment the deadman switch 274 triggers a relay located in controller 221, and the relay activates the three-way directional servovalve 271. This is necessary when the voltage required to activate the three-way directional valve 271 is different from the voltage required to activate the deadman switch 274.

Figure 17:
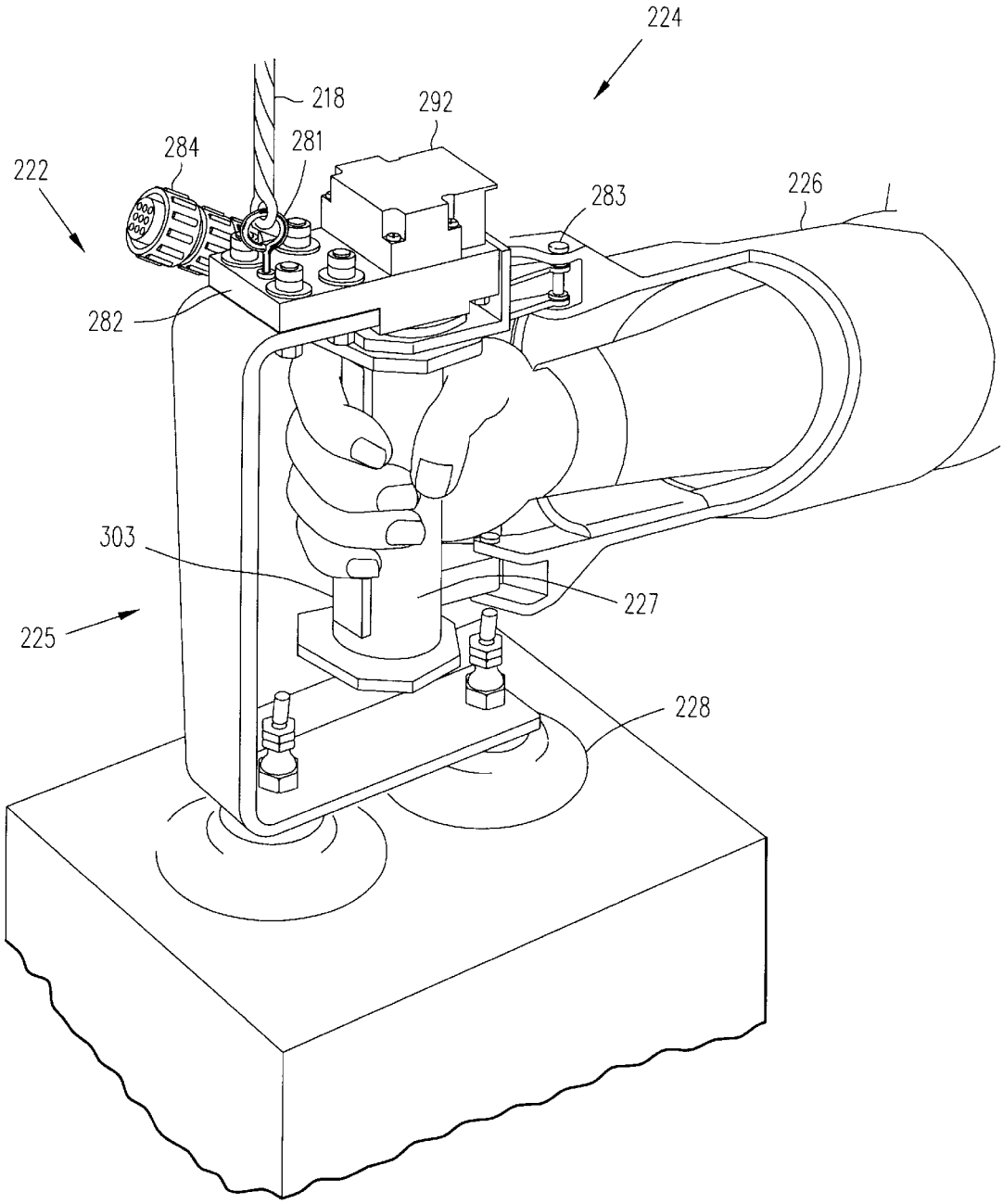
FIG. 17 is a perspective view of an embodiment of an end-effector

FIG. 17 shows a detailed view of end-effector 222. End-effector 222 includes a human interface subsection 224 and a load interface subsection 225. Human interface subsection 224 includes the handle 227 which is grasped by the operator and thus measures the human force imposed on end-effector 222 (not the load force). Load interface subsection 225 includes a hook or a suction cup 228 or any other type of device that can be used to hold or support an object. An eyelet 281 is mounted in bracket 282 for connecting bracket 282 to a rope 218 if this end-effector 222 is used with the material handling device 210 shown in FIG. 11. Bracket 282 also has bolt holes for connecting the end-effector 222 to the material handling devices shown in FIGS. 12, 13 and 14. Brace 226 is connected to the human interface subsection 224 and has two components which rotate relative to each other via the hinge 283 so as allow the operator to bend his/her wrist in the horizontal plane comfortably. Brace 226 does not allow the operator to bend his/her wrist in the vertical plane. A lever 303 is connected to the handle 227 and activates the deadman switch 274 (see FIG. 18) when the operator grips the handle 227. All signal cables from the force measuring device 292 and the deadman switch 274 are attached to connector 284.

Figure 18:
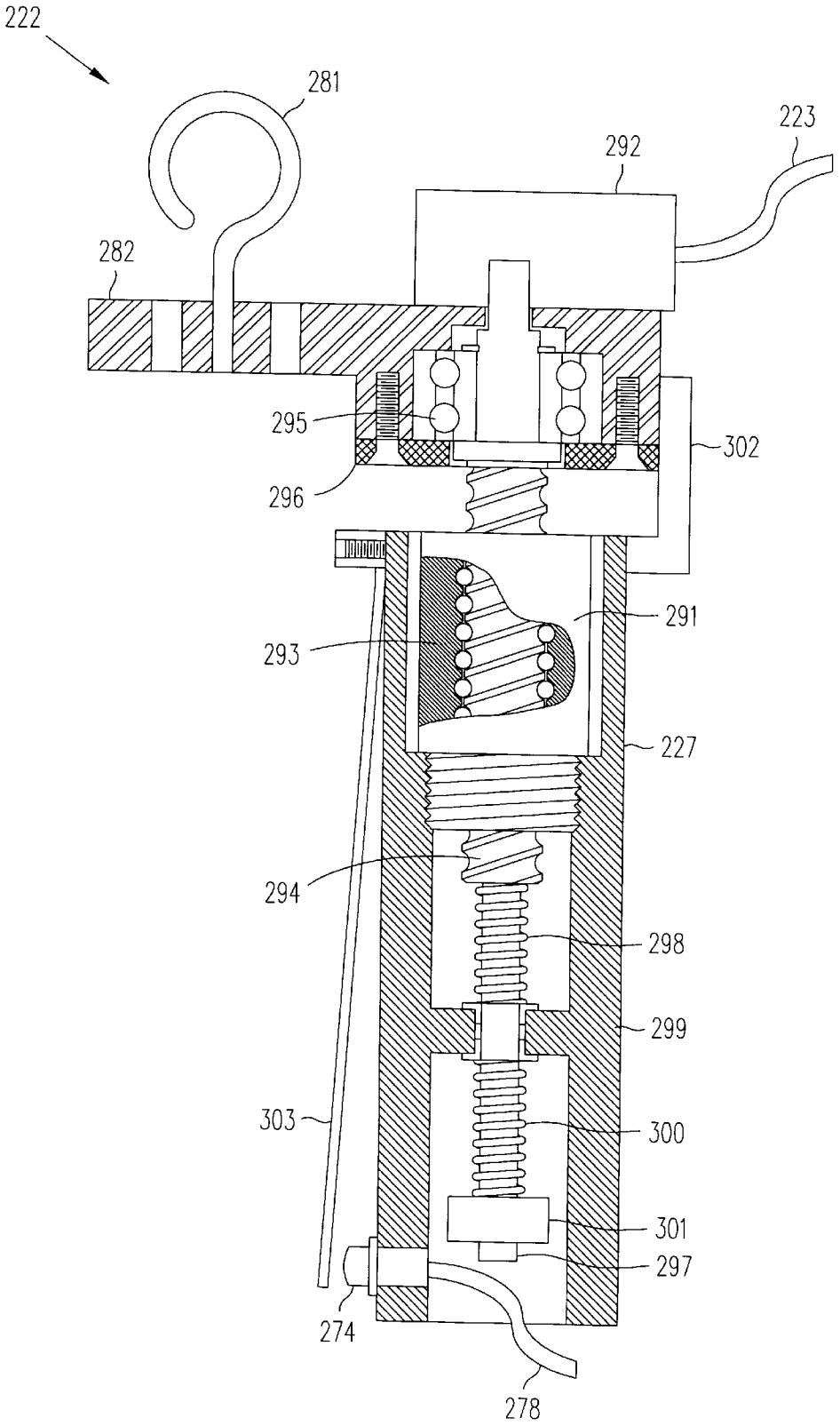
FIG. 18 is a cross-sectional partially broken-away view of the end-effector showing a displacement detector for measuring the force imposed on the end-effector by an operator.

FIG. 18 is a cross-sectional partially broken away view of the end-effector 222. A ball-screw mechanism 291 translates the vertical displacement of handle 227 into a rotary displacement which is measured by an angle measuring device 292. The handle 227 is connected to the ball-nut portion 293 of the ball-screw mechanism 291. The screw 294 of the ball-screw mechanism 291 is secured by the inner race of a bearing system 295. The bearing system 295, here a double row bearing, includes any combination of bearing(s) that allows rotation of the screw 294 while supporting vertical and horizontal forces. A pair of angular contact bearings could also be used. Because of the connection between the screw 294 and the inner race of the bearing system 295, the inner race and the screw 294 turn together. The outer race of the bearing system 295 is held in a bracket 282 by a retaining ring 296 which is fixed to the bottom of the bracket 282. A shaft 297 extends downwards from the lower end of the screw 294 along the axis of the handle 227. An upper coil spring 298 is positioned around the shaft 297 between the screw 294 and a shoulder 299 formed inside the handle 227. A lower coil spring 300 is positioned around the shaft 297 between the stop 301 fixed to the shaft 297 and the shoulder 299 formed inside the handle 227. Stop 301 can be a clamp ring. Thus the coil spring 298 urges the handle 227 downward, and the coil spring 300 urges the handle 227 upward. Together the springs 298 and 300 let the handle 227 move axially with respect to the screw 294 and the shaft 297. The springs 298 and 300 return the handle 227 to an equilibrium position when the handle 227 is not pushed. The bracket 302 mounted on the handle 227 prohibits the rotation of the handle 227 relative to the screw 294. The handle 227, which is connected to the ball-nut 293 of the ball-screw mechanism 291, is held by the operator.

If the handle 227 is moved up and down, then the screw 294 turns. The amount of rotation of the screw 294 depends on the lead of the screw 294. For example, if the lead is ½ inch, then for every ½ inch motion of the handle 227, the screw 294 turns one revolution. The angle measuring device 292 connected to the top of the bracket 282 measures the rotation of the screw 294. The angle measuring device 292 can be an optical rotary encoder, a magnetic rotary encoder, a rotary potentiometer, a RVDT (Rotary Variable Differential Transformer), an analog resolver, a digital resolver, a capacitive rotation sensor, or a Hall effect sensor. The angle measuring device 292 produces a signal proportional to the rotation of the screw 294.

To maintain tension in the rope 218, an upward velocity is imposed on the rope 218 when there is no load on the system (assuming that the end-effector 222 itself is negligibly light). In this case, only one spring, either a compression spring beneath shoulder 299 or a tension spring above shoulder 299 is sufficient to force the handle 227 upward. When using the end-effector 222, the operator grasps the handle 227. When the operator initiates an upward motion, the handle 227 (connected to the ball-nut 293) moves upward, causing the screw 294 to turn (e.g., clockwise). This motion is recorded by the angle measuring device 292. The signal generated by the angle measuring device 292 is then transmitted to the controller 221 (FIG. 1). The actuator 211 turns appropriately, causing an upward motion of the rope 218 and the end-effector 222. This motion lifts the load 219 and the end-effector 222 together. Similarly, when the operator initiates a downward motion, the actuator 211 turns appropriately in the opposite direction, causing a downward motion of the rope 218 and the end-effector 222. Thus, in the end-effector 222, the vertical displacement of handle 227 relative to bracket 282 (a displacement that is proportional to the human force) is measured. This measurement is fed to the controller 221. Regardless of the type of displacement sensor used in this device and its installation procedure, this end-effector 222 is designed to measure only the human force in the vertical direction. The end-effector 222 does not measure the load force. The deadman/safety switch 274 is installed to transfer the actuator 211 to another control mode (i.e., position control mode) or to turn the system off when the operator leaves the system. A lever 303 is connected to the handle 227 to activate the deadman/safety switch 274 when the operator grasps the handle 227.

The sole purpose of the springs 298 and 300 installed in the end-effector 222 is to bring the handle 227 back to an equilibrium position when no force is imposed on the handle 227 by the operator. FIGS. 17 and 18 show the end-effector 222 using compression springs 298 and 300. Other kinds of springs can be used, such as cantilever beam springs, tension springs or belleville springs. Basically, any resilient element capable of bringing the handle 227 back to its equilibrium position will be sufficient. The structural damping in the springs or the friction in the moving elements of the end-effector 222 (e.g., bearings) should provide sufficient damping in the system to provide stability.

Next the controller 221 associated with this human power amplifier module will be described. The force or displacement sensor 292 (FIG. 18) in the end-effector 222 delivers a signal to the controller 221 (FIG. 11) that is used to control the actuator 211 and to send an appropriate signal to the pneumatic circuitry 220. If e is the input command to the pneumatic circuitry 220, then, in the absence of any other external force on the actuator 211, the linear velocity v of the outermost point of the end-effector 222 velocity v can be represented by:

$$v=G_O \cdot e \tag{8}$$

where $G_O$ is the transfer function relating the input command e to end-effector velocity v. (A downward rope velocity is considered positive in this analysis.) In addition to the input command e from the controller the forces imposed on the end-effector also affect the end-effector velocity. There are two forces imposed on the end-effector which affect the end-effector velocity: a force f which is imposed by the operator's hand, and a force, p, which is imposed by the load on the end-effectors (see FIG. 19). The input command e and the forces on the end-effectors contribute to the end-effector speed such that:

$$v=G_O \cdot e+S_O(f+p)-v_{up} \tag{9}$$

where $S_O$ is the actuator sensitivity function which relates the external forces to the endpoint velocity v. $S_O$ is defined as the downward velocity of the end-effector if one unit of impulse tensile force is imposed on the rope. If a velocity controller is designed for the actuator so that $S_O$ is small, the actuator has only a small response to the imposed tensile force on the rope. A high-gain controller in the closed-loop velocity system results in a small $S_O$ and consequently a small actuator velocity in response to forces imposed on the end-effector. To develop tension in the rope at all times if the module is to be used with the device of FIG. 11, an upward biased rope velocity, $v_{up}$, is introduced to the system. M is the mass of the object being lifted. E and H are the impedances of the end-effector spring and human arm, respectively.

A reasonable performance specification for the actuator is the level of amplification of the operator force f that is applied to the end-effector. If the force amplification is large, a small force applied by the operator results in a large force being applied to the load via the device. If the amplification is small, a small force applied by the operator results in a small force being applied to the load via the device. Consequently, if the amplification is large, the operator "feels" only a small percentage of the force required to lift the load. Importantly, at any chosen amplification, the operator still retains a sensation of the dynamic characteristics of the free mass, yet the load essentially "feels" lighter. Thus the system performance can be defined as a number that represents the force amplification. For example, when the force amplification of the system is programmed to be 5, for every 5 pound-force on the end-effector the operator imposes (and feels) one pound on the end-effector. The following explains how to guarantee this performance for the device. The operator force f is measured and passed through the controller 221 which delivers a signal e to the actuator 211. If the transfer function of the controller is represented by K, then the output of the controller, e, is equal to K·f.

Substituting for e in equation (9) results in the following equation for the rope velocity v:

$$v=G_O \cdot K \cdot f+S_O(f+p)-v_{up} \tag{10}$$

Any variation in the load's force on the end-effector, Δp, will result in a variation in the force on the operator's hand according to the following equation if no change in maneuvering speed is expected:

$$\left(\frac{G_O K}{S_O}+1\right)\Delta f=-\Delta p \tag{11}$$

where Δf is the change in the human force on the end-effector. The term (GoK/So+1) in equation (11) is the force amplification factor. This term relates the variation in the load force, Δp, to the variation of the human force, Δf. The larger K is chosen to be, the greater the force amplification in the system. K must be designed to yield an appropriate force amplification.

Figure 19:
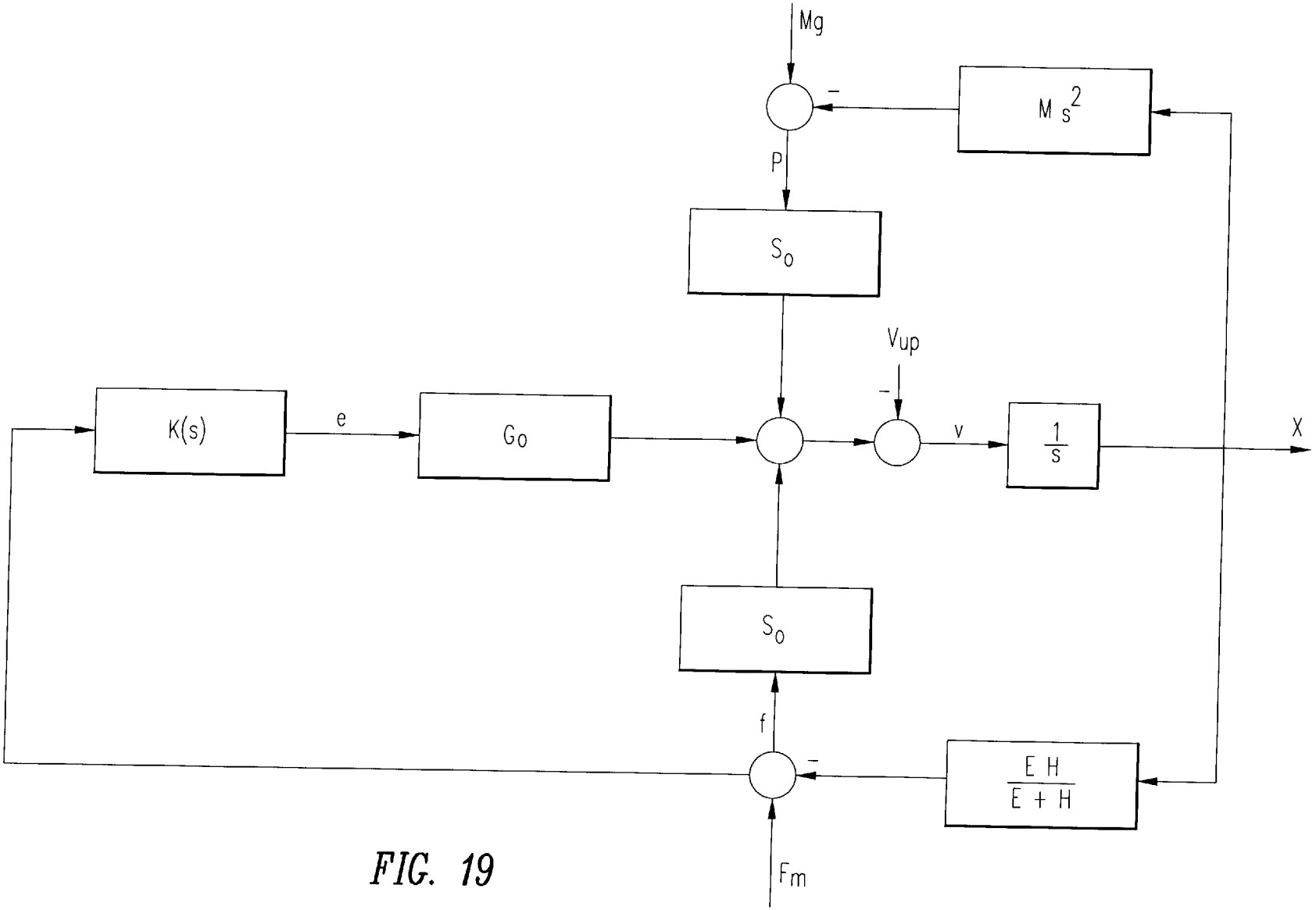
FIG. 19 is a schematic diagram illustrating the manner in which the operator, actuator and load forces interact with the elements of the pneumatic human power amplifier module

FIG. 19 shows diagramatically how the human force and load force are generated. As FIG. 19 indicates, K may not be arbitrarily large. Rather, the choice of K must guarantee the closed-loop stability of the system shown in FIG. 19. The operator force f is a function of the human arm impedance H and sensor dynamics E, whereas the load force p is a function of the load mass M. There are many model-based algorithms available in the control literature capable of providing a transfer function K for the controller which stabilizes the system such that the load and end-effector follow the operator's hand.

Although particular embodiments of the invention are illustrated in the accompanying drawings and described in the foregoing detailed description, it is understood that the invention is not limited to the embodiments disclosed, but is intended to embrace any alternatives, equivalents, modifications and/or arrangements of elements falling within the scope of the invention as defined by the following claims. The following claims are intended to cover all such modifications and alternatives.

I claim:

1. A pneumatic human power amplifier module for connection to a pneumatic actuator for driving a lifting device to lift or lower a load, said module comprising:

an end-effector for engaging the load, said end-effector including a sensor for detecting a human force on the end-effector;

a controller arranged to receive an output signal from said sensor; and a pneumatic circuit attachable to said pneumatic actuator, said pneumatic circuit being arranged to receive an output signal from said controller and to control an air flow into and out of said pneumatic actuator such that said pneumatic actuator causes said lifting device to impose a device force on the load such that the total of said human force and said device force taken together causes the end-effector and the load to follow an operator's hand as said operator manipulates said end-effector and said load.

2. The pneumatic human power amplifier module of claim 1 wherein said device force is larger than said human force.

3. The pneumatic human power amplifier module of claim 1 wherein said human force is equal to a predetermined percentage of said total of said human force and said device force.

4. The pneumatic human power amplifier module of claim 1 wherein said pneumatic circuit comprises a flow control proportional servovalve for controlling an air flow into and out of said pneumatic actuator.

5. The pneumatic human power amplifier module of claim 1 wherein said pneumatic circuit comprises a pressure control proportional servovalve for controlling the pressure of an air flow into and out of said pneumatic actuator.

6. The pneumatic human power amplifier module of claim 4 or 5 wherein said pneumatic circuit comprises an UP valve and a DOWN valve for overriding said proportional servovalve, said UP valve being operable manually to cause an air flow into said pneumatic actuator, said DOWN valve being operable manually to cause an air flow out of said pneumatic actuator.

7. The pneumatic human power amplifier module of claim 6 wherein said UP valve is connected in parallel with said proportional servovalve for manually controlling an air flow from a supply pressure to said pneumatic actuator.

8. The pneumatic human power amplifier module of claim 6 wherein said DOWN valve is connected in parallel with said proportional servovalve for manually controlling an air flow out of said pneumatic actuator to the ambient atmosphere.

9. The pneumatic human power amplifier module of claim 6 wherein said UP and DOWN valves are for allowing manual operation of said lifting device in the event of a failure of said controller and/or said sensor.

10. The pneumatic human power amplifier module of claim 6 wherein said UP and DOWN valves are for allowing manual operation of said lifting device in the event of an electric power failure.

11. The pneumatic human power amplifier module of claim 6 wherein said pneumatic circuit comprises a directional servovalve and said end-effector comprises a deadman switch, said directional servovalve providing an air passage between said proportional servovalve and said pneumatic actuator when said deadman switch is in a first position.

12. The pneumatic human power amplifier module of claim 11 wherein said directional servovalve provides an air passage between said pneumatic actuator and said UP and DOWN valves when said deadman switch is in a second position.

13. The pneumatic human power amplifier module of claim 12 wherein said UP and DOWN valves allow said pneumatic actuator to be operated manually when deadman switch is in said second position.

14. The pneumatic human power amplifier module of claim 11 wherein said directional servovalve is arranged to receive an output signal from said deadman switch.

15. The pneumatic human power amplifier module of claim 1 wherein said end-effector comprises a human interface subsection for interfacing with an operator and a load interface subsection for engaging a load.

16. The pneumatic human power amplifier module of claim 15 wherein said human interface subsection comprises a handle to be grasped by an operator.

17. The pneumatic human power amplifier module of claim 16 wherein said pneumatic circuit comprises a directional servovalve and said end-effector comprises a deadman switch, an output signal from said deadman switch actuating said directional servovalve so as to provide an air passage between said proportional servovalve and said pneumatic actuator when said deadman switch is in a first position.

18. The pneumatic human power amplifier module of claim 17 wherein said deadman switch is moved from a second position to said first position when an operator grasps said handle.

19. The pneumatic human power amplifier module of claim 15 wherein said human interface subsection further comprises a brace for engaging the operator's forearm.

20. The pneumatic human power amplifier module of claim 19 wherein said brace encircles the operator's forearm and is connected to two ends of said handle with a vertical hinge such that the operator can flex his or her wrist only in a horizontal plane when lifting a load with the end-effector.

21. The pneumatic human power amplifier module of claim 15 wherein said end-effector comprises a position sensor for detecting a relative position of said handle with respect to said load interface subsection, an output signal from said position sensor representing said relative position of said handle with respect to said load interface subsection.

22. The pneumatic human power amplifier module of claim 21 wherein said human interface subsection comprises a ball-screw arrangement for converting a linear motion of said handle relative to said load interface subsection into a rotary motion, said ball-screw arrangement comprising a nut portion and a screw portion.

23. The pneumatic human power amplifier module of claim 21 wherein said human interface subsection comprises a lead-screw arrangement for converting a linear motion of said handle relative to said load interface subsection into a rotary motion, said lead-screw arrangement comprising a nut portion and a screw portion.

24. The pneumatic human power amplifier module of claim 22 or 23 wherein said screw portion is rotatably held by the load interface subsection and said nut portion is constrained to move linearly along a major axis of said screw portion.

25. The pneumatic human power amplifier module of claim 22 or 23 wherein said nut portion is attached to said handle.

26. The pneumatic human power amplifier module of claim 22 or 23 wherein said position sensor comprises an angle-measuring device for measuring a rotation of said screw portion relative to said nut portion.

27. The pneumatic human power amplifier module of claim 26 wherein said angle-measuring device is selected from the group consisting of a rotary potentiometer, a rotary optical encoder, and a rotary magnetic encoder.

28. The pneumatic human power amplifier module of claim 22 or 23 wherein said end-effector comprises at least one spring for maintaining said handle in an equilibrium position when no force is imposed on said handle by an operator.

29. The pneumatic human power amplifier module of claim 15 wherein said load interface subsection is designed for attachment to an endpoint of said lifting device.

30. The pneumatic human power amplifier module of claim 15 wherein said load interface subsection comprises a mechanism for engaging a load.

31. The pneumatic human power amplifier module of claim 30 wherein said mechanism for engaging a load comprises at least one suction cup.

32. The pneumatic human power amplifier module of claim 30 wherein said mechanism for engaging a load comprises at least one hook.

33. A human power amplifier apparatus comprising:

a lifting device;

a pneumatic actuator; and a pneumatic human power amplifier module coupled to said pneumatic actuator for driving said lifting device to lift or lower a load, said module comprising:

an end-effector for engaging the load, said end-effector including a sensor for detecting a human force on the end-effector;

a controller arranged to receive an output signal from said sensor; and a pneumatic circuit coupled to said pneumatic actuator, said pneumatic circuit being arranged to receive an output signal from said controller and to control an air flow into and out of said pneumatic actuator such that said pneumatic actuator causes said lifting device to impose a device force on the load such that said human force and said device force together lift the load.

34. The human power amplifier apparatus of claim 33 wherein said human force is equal to a predetermined percentage of a total of said human force and said device force.

35. A method by which a human operator manipulates a load comprising the steps of:

gripping an end-effector with said operator's hand;

using the end-effector to engage the load;

applying an operator force against said end-effector;

measuring said operator force;

using said measured operator force to control a flow of air into a pneumatic actuator; and controlling said flow of air into said pneumatic actuator such that said pneumatic actuator causes a lifting device to transmit a device force to said end-effector such that said end-effector and said load follow said operator's hand.

36. The method of claim 35 wherein the step of controlling comprises controlling said flow of air such that said operator force is equal to a predetermined percentage of a total of said operator force and said device force.

37. The method of claim 35 wherein the step of controlling comprises controlling said flow of air such that said operator force is less than said device force.

38. The method of claim 35 wherein the step of controlling said flow of air comprises providing a first signal representative of said measured operator force to a computer and using said computer to generate a second signal to a proportional servovalve.

39. A human power amplifier apparatus comprising:

a lifting device;

a pneumatic actuator; and a pneumatic human power actuator module coupled to said pneumatic actuator for driving said lifting device to lift or lower a load, said module comprising:

an end-effector for engaging the load, said end-effector including a sensor for detecting a human hand motion in the end-effector;

a controller arranged to receive an output signal from said sensor; and a pneumatic circuit coupled to said pneumatic actuator, said pneumatic circuit being arranged to receive an output signal from said controller and to control an air flow into said pneumatic actuator such that said pneumatic actuator causes said lifting device to impose a device force on the load such that said human force and said device force together lift the load.

* * * * *

UNITED STATES PATENT AND TRADEMARK OFFICE

CERTIFICATE OF CORRECTION

PATENT NO. : 5,915,673
DATED : June 29, 1999
INVENTOR(S) : Kazerooni

It is certified that error appears in the above-identified patent and that said Letters Patent is hereby corrected as shown below:

Title page,
Item [54], please replace the word "AMPLIFER" with the word -- AMPLIFIER --.

Column 1,
Before "FIELD OF THE INVENTION" please insert the following:

-- GOVERNMENT SUPPORT

This work was supported in part by a grant from the National Science Foundation, Grant No. MSS-9196179. The government may have certain rights in this invention. --

Signed and Sealed this

Twenty-fifth Day of December, 2001

*Attest:*

*Attesting Officer*

JAMES E. ROGAN
*Director of the United States Patent and Trademark Office*